US011731846B2

(12) United States Patent
Kawarada

(10) Patent No.: US 11,731,846 B2
(45) Date of Patent: Aug. 22, 2023

(54) SHEET FEEDING DEVICE, IMAGE FORMING APPARATUS, AND CONTROL METHOD

(71) Applicant: Ricoh Company, Ltd., Tokyo (JP)

(72) Inventor: Masaya Kawarada, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 185 days.

(21) Appl. No.: 17/188,957

(22) Filed: Mar. 1, 2021

(65) Prior Publication Data

US 2021/0284472 A1 Sep. 16, 2021

(30) Foreign Application Priority Data

Mar. 16, 2020 (JP) ..... 2020-044978

(51) Int. Cl.

| | |
|---|---|
| ***B65H 3/46*** | (2006.01) |
| ***B65H 3/06*** | (2006.01) |
| ***G03G 15/00*** | (2006.01) |
| ***B65H 7/12*** | (2006.01) |
| ***B65H 3/52*** | (2006.01) |

(52) U.S. Cl.

CPC ..... *B65H 3/46* (2013.01); *B65H 3/0669* (2013.01); *B65H 3/5261* (2013.01); *B65H 7/12* (2013.01);

(Continued)

(58) Field of Classification Search

CPC ..... B65H 3/46; B65H 3/52; B65H 3/5261; B65H 7/02; B65H 7/12; B65H 7/125;

(Continued)

(56) References Cited

U.S. PATENT DOCUMENTS 7,334,788 B2 2/2008 Sakamaki et al.
7,392,980 B2 * 7/2008 Takeuchi ..... B65H 3/5261 271/265.01

(Continued)

FOREIGN PATENT DOCUMENTS

JP 2006-027844 2/2006

OTHER PUBLICATIONS

Extended European Search Report dated Jul. 23, 2021 in European Patent Application No. 21160811.2, 7 pages.

*Primary Examiner* — Prasad V Gokhale
(74) *Attorney, Agent, or Firm* — Xsensus LLP

(57) ABSTRACT

A sheet feeding device includes a conveyance rotator, a separation rotator, a torque applier, a torque control circuit, and a torque transmission switcher. The conveyance rotator conveys a sheet in a sheet feeding direction. The separation rotator sandwiches the sheet together with the conveyance rotator. The torque applier applies a reverse torque to the separation rotator in a sheet reversing direction to reverse the sheet. The torque control circuit controls the reverse torque applied to the separation rotator to be equal to or less than a given value. The torque transmission switcher switches, between a transmission state and a non-transmission state, a state of a torque transmission path between the torque applier and the separation rotator. The transmission state is a state in which the reverse torque is transmitted. The non-transmission state is a state in which the reverse torque is not transmitted.

16 Claims, 11 Drawing Sheets

(52) U.S. Cl.
CPC ..... *G03G 15/6529* (2013.01); *B65H 2403/70* (2013.01); *B65H 2403/72* (2013.01); *B65H 2511/524* (2013.01); *B65H 2515/32* (2013.01); *B65H 2515/70* (2013.01)

(58) Field of Classification Search
CPC ..... B65H 7/14; B65H 7/18; B65H 2403/70; B65H 2403/72; B65H 2403/732; B65H 2511/524; B65H 2515/32; B65H 2515/70
See application file for complete search history.

(56) References Cited

U.S. PATENT DOCUMENTS

| | | | | |
|---|---|---|---|---|
| 2004/0188916 | A1* | 9/2004 | Tsukamoto | B65H 7/06 271/110 |
| 2015/0158309 | A1 | 6/2015 | Fujii et al. | |
| 2015/0360893 | A1* | 12/2015 | Kuwata | B65H 3/5261 399/397 |
| 2015/0375498 | A1 | 12/2015 | Horikawa et al. | |
| 2016/0004202 | A1 | 1/2016 | Morita et al. | |
| 2016/0008061 | A1 | 3/2016 | Kawarada et al. | |
| 2016/0080611 | A1 | 3/2016 | Yorimoto et al. | |
| 2016/0171348 | A1 | 6/2016 | Satoh et al. | |
| 2016/0347052 | A1 | 12/2016 | Kawarada et al. | |
| 2016/0366288 | A1 | 12/2016 | Sasa et al. | |
| 2017/0210582 | A1* | 7/2017 | Okano | B65H 7/125 |
| 2017/0361605 | A1 | 12/2017 | Kawarada et al. | |
| 2018/0141329 | A1 | 5/2018 | Aoyagi et al. | |
| 2018/0141359 | A1 | 5/2018 | Kawarada et al. | |
| 2018/0147835 | A1 | 5/2018 | Nakamura et al. | |
| 2020/0207119 | A1 | 7/2020 | Kawarada et al. | |
| 2020/0299088 | A1* | 9/2020 | Umi | B65H 3/5284 |

* cited by examiner

SHEET FEEDING DEVICE, IMAGE FORMING APPARATUS, AND CONTROL METHOD

CROSS-REFERENCE TO RELATED APPLICATION

This patent application is based on and claims priority pursuant to 35 U.S.C. § 119(a) to Japanese Patent Application No. 2020-044978, filed on Mar. 16, 2020, in the Japan Patent Office, the entire disclosure of which is hereby incorporated by reference herein.

BACKGROUND

Technical Field

Embodiments of the present disclosure generally relate to a sheet feeding device, an image forming apparatus, and a control method.

Related Art

There is known a sheet feeding device that typically includes a conveyance rotator, a separation rotator, a torque applier, and a torque controller. The conveyance rotator conveys a sheet in a sheet feeding direction. The separation rotator sandwiches the sheet together with the conveyance rotator. The torque applier applies a reverse torque to the separation rotator in a sheet reversing direction to reverse the sheet. The torque controller controls the reverse torque applied to the separation rotator to be equal to or less than a given value.

SUMMARY

In one embodiment of the present disclosure, a novel sheet feeding device includes a conveyance rotator, a separation rotator, a torque applier, a torque control circuit, and a torque transmission switcher. The conveyance rotator is configured to convey a sheet in a sheet feeding direction. The separation rotator is configured to sandwich the sheet together with the conveyance rotator. The torque applier is configured to apply a reverse torque to the separation rotator in a sheet reversing direction to reverse the sheet. The torque control circuit is configured to control the reverse torque applied to the separation rotator to be equal to or less than a given value. The torque transmission switcher is configured to switch, between a transmission state and a non-transmission state, a state of a torque transmission path between the torque applier and the separation rotator. The transmission state is a state in which the reverse torque is transmitted. The non-transmission state is a state in which the reverse torque is not transmitted.

Also described are novel image forming apparatus incorporating the sheet feeding device and method for controlling a torque transmission switcher in a sheet feeding device.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
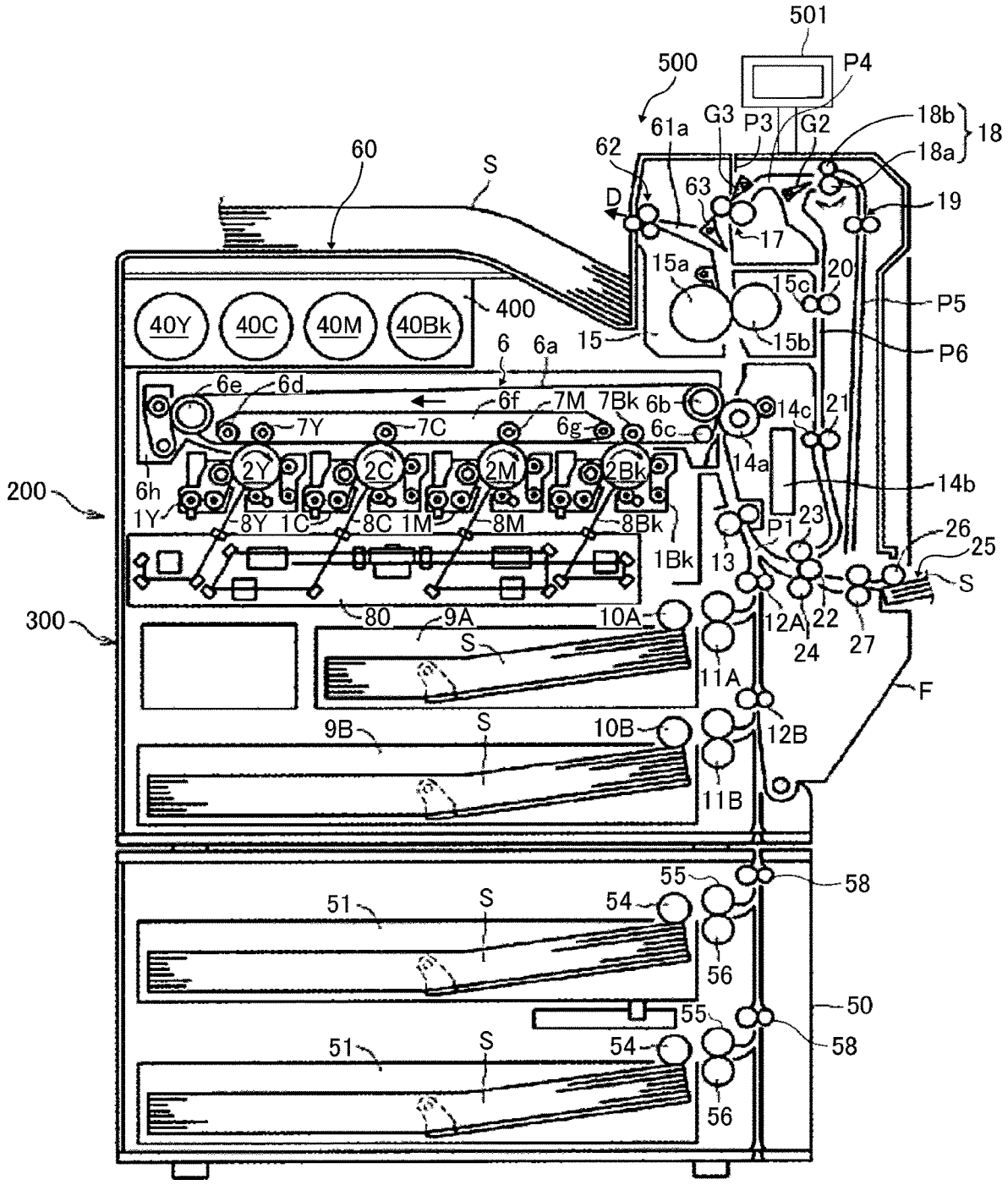
FIG. 1 is a schematic view of a printer according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

The terminology used herein is for the purpose of describing particular embodiments only and is not intended to be limiting of the present disclosure. As used herein, the singular forms "a, "an," and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

In a later-described comparative example, embodiment, and exemplary variation, for the sake of simplicity, like reference numerals are given to identical or corresponding constituent elements such as parts and materials having the same functions, and redundant descriptions thereof are omitted unless otherwise required.

It is to be noted that, in the following description, suffixes Y, C, M, and K denote colors of yellow, cyan, magenta, and black, respectively. To simplify the description, these suffixes are omitted unless necessary.

Referring to the drawings, wherein like reference numerals designate identical or corresponding parts throughout the several views, embodiments of the present disclosure are described below.

Figure 2:
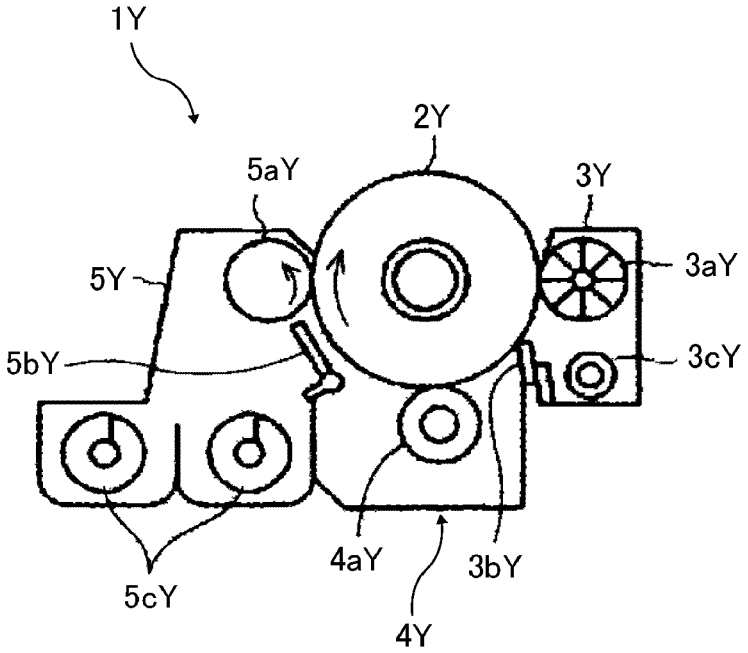
FIG. 2 is a schematic view of a yellow image forming station of four image forming stations.

Initially with reference to FIGS. 1 and 2, a description is given of an embodiment in which a sheet feeding device is included in a color laser printer serving as a tandem image forming apparatus in which photoconductors are arranged side by side. The color laser printer is hereinafter simply referred to a printer 500.

Note that, instead of the color laser printer, the sheet feeding device may be included in an image forming apparatus such as a copier, a facsimile machine, or a multifunction peripheral (MFP) having at least two of copying, printing, scanning, facsimile, and plotter functions. The sheet feeding device may be included in an image forming apparatus that employs, e.g., an electrophotographic image forming method, an inkjet image forming method, or a stencil printing method. The sheet feeding device may be included in an image reading apparatus that includes no image forming apparatus. The apparatus that includes the sheet feeding device is not limited to an image forming apparatus or an image reading apparatus. The sheet feeding device may be included in any apparatus provided that the apparatus is provided with a driving device that drives an object.

FIG. 1 is a schematic view of the printer 500 according to the present embodiment.

The printer 500 includes an image forming part 200 serving as an image forming device and a sheet feeding part 300 serving as a sheet feeding device. The sheet feeding part 300 is disposed below the image forming part 200 in FIG. 1. Inside the printer 500, the image forming part 200 includes four image forming stations 1Y, 1M, 1C, and 1Bk that form images in different colors, namely, yellow (Y), cyan (C), magenta (M), and black (Bk), respectively. The image forming stations 1Y, 1M, 1C, and 1Bk include drum-shaped photoconductors 2Y, 2M, 2C, and 2Bk, respectively. The four photoconductors 2Y, 2M, 2C, and 2Bk are arranged side by side while being separated from each other at equal intervals in a lateral direction inside the image forming part 200 in FIG. 1. When the printer 500 starts operation, each of the photoconductors 2Y, 2M, 2C, and 2Bk is driven to rotate in a direction indicated by arrow in FIG. 1 by a driving force transmitted from a driving source.

The four image forming stations 1Y, 1M, 1C, and 1Bk include various pieces of image forming equipment such as a developing device around the photoconductors 2Y, 2M, 2C, and 2Bk, respectively, to form images by electrophotography. In the description of the present embodiment, for convenience, Y (yellow), C (cyan), M (magenta), and Bk (black) are appended, as suffixes, to the reference numerals indicating the constituent elements of the image forming stations 1Y, 1M, 1C, and 1Bk, respectively, so as to represent the colors of toner images to be formed. In general description, in particular, these suffixes may be omitted.

In the printer 500, the four image forming stations 1Y, 1M, 1C, and 1Bk have substantially identical configurations, differing from each other in the color of toner employed.

FIG. 2 is a schematic view of the yellow image forming station 1Y of the four image forming stations 1Y, 1M, 1C, and 1Bk.

As illustrated in FIG. 2, the image forming station 1Y includes various pieces of image forming equipment such as a charger 4Y, a developing device 5Y, and a cleaner 3Y sequentially arranged around a photoconductor 2Y according to an electrostatic imaging process. The charger 4Y includes a charging roller 4*a*Y facing the photoconductor 2Y. The developing device 5Y includes a developing roller 5*a*Y, a developing blade 5*b*Y, and screws 5*c*Y. The cleaner 3Y includes a cleaning brush 3*a*Y, a cleaning blade 3*b*Y, and a collecting screw 3*c*Y.

The photoconductor 2Y is, e.g., an aluminum cylinder having a diameter of about 30 mm to about 120 mm coated by a photoconductive, organic semiconductor layer, thus having a layer structure. Alternatively, the photoconductor 2Y may be a belt photoconductor.

Referring back to FIG. 1, below the photoconductors 2Y, 2M, 2C, and 2Bk is an exposure device 80 serving as a latent image writer that irradiates the surface of the photoconductors 2 uniformly charged by the respective chargers 4 with laser beams 8 corresponding to image data of respective colors, to form electrostatic latent images on the surface of the photoconductors 2. Between the charger 4 and the developing device 5, an elongated space is secured in an axial direction of the photoconductor 2 so that the laser beam 8 emitted by the exposure device 80 passes through the elongated space and reaches the photoconductor 2.

The exposure device 80 illustrated in FIG. 1 employs a laser scanning system with, e.g., laser light sources and polygon mirrors. Four semiconductor lasers emit the laser beams 8 (specifically, laser beams 8Y, 8C, 8M, and 8Bk) modulated according to the image data to be formed. The exposure device 80 includes a metal or resin housing to accommodate optical parts and control parts. An upper surface of the housing has four emitting apertures through which the laser beams 8 are emitted. Each of the emitting apertures is provided with a translucent dust-proof member. Although the exposure device 80 includes a single housing in the printer 500 illustrated in FIG. 1, respective exposure devices may be provided for the image forming stations 1. The exposure device 80 may employ a combination of a light emitting diode (LED) array and an imaging device, instead of employing the laser light sources.

A toner detector detects consumption of the yellow (Y), cyan (C), magenta (M), and black (Bk) toners in the respective developing devices 5. Four toner cartridges 40Y, 40C, 40M, and 40Bk are disposed in an upper portion of the printer 500 and contain the yellow (Y), cyan (C), magenta (M), and black (Bk) toners, respectively. Each of the toner cartridges 40 is provided with a toner supplier, which supplies the toner from the toner cartridge 40 to the developing device 5.

Specifically, the outer shell of each of the toner cartridges 40 is a container made of, e.g., resin or paper and provided with a discharge port as a part of the container. The toner cartridges 40 are easily attachable to and removable from an attachment 400 of the printer 500. When the toner cartridges 40 are attached to the attachment 400, the respective discharge ports are coupled to the corresponding toner suppliers disposed in a main body of the printer 500. In the printer 500, the attachment 400 and the toner cartridges 40 are shaped in a pair to prevent the toner cartridge 40 for a color from being erroneously attached and the toner is supplied to the developing device 5 for another color. Alternatively, any other measures may be taken to prevent such erroneous attachment.

As representatively illustrated in FIG. 2, the developing device 5Y of the yellow image forming station 1Y includes the two screws 5*c*Y for stirring and conveying toner and carrier. When the developing device 5Y is attached to the printer 500, one end of the toner supplier is coupled to a part above the left screw 5*c*Y in FIG. 2. The screws 5*c*Y supply the toner to the developing roller 5*a*Y rotating in a direction indicated by arrow in FIG. 2. The developing blade 5*b*Y regulates the thickness of the toner layer on the surface of the developing roller 5*a*Y to a given thickness.

The developing roller 5*a*Y is a cylinder made of stainless steel or aluminum. The developing roller 5*a*Y is rotatably supported by the frame of the developing device 5Y so as to regularly ensure the distance between the developing roller 5*a*Y and the photoconductor 2Y. A magnet is disposed inside the developing roller 5*a*Y to form given magnetic lines of force. The developing device 5 develops, with the toner for each of the colors, the electrostatic latent image formed on the surface of the photoconductors 2 with the laser beam 8, thus rendering the electrostatic latent image visible as a toner image.

Referring back to FIG. 1, an intermediate transfer device 6 is disposed above the photoconductors 2Y, 2M, 2C, and 2Bk. The intermediate transfer device 6 includes an intermediate transfer belt 6*a* serving as an image bearer entrained around multiple rollers 6*b*, 6*c*, 6*d*, and 6*e*. As the roller 6*b* is driven to rotate by a driving force transmitted from a driving source, the intermediate transfer belt 6*a* is rotated by the rotation of the roller 6*b* in a direction indicated by arrow in FIG. 1. The intermediate transfer belt 6*a* is an endless belt entrained around the multiple rollers 6*b*, 6*c*, 6*d*, and 6*e* such that the surface of each of the photoconductors 2 contacts the intermediate transfer belt 6*a* after facing the corresponding developing device 5. Four primary transfer rollers 7Y, 7M, 7C, and 7Bk are disposed opposite the photoconductors 2Y, 2M, 2C, and 2K, respectively, in a loop formed by the intermediate transfer belt 6*a*.

A belt cleaner 6*h* is disposed on an outer circumference of the intermediate transfer belt 6*a* at a position opposite the roller 6*e* (hereinafter referred to as a cleaning opposed roller 6*e*). The belt cleaner 6*h* removes residual toner and foreign matters such as paper powder from an outer circumferential surface of the intermediate transfer belt 6*a*. The cleaning opposed roller 6*e* facing the belt cleaner 6*h* is provided with a tension applier that applies tension to the intermediate transfer belt 6*a*. The cleaning opposed roller 6*e* is movable to keep an appropriate belt tension. The belt cleaner 6*h* facing the cleaning opposed roller 6*e* via the intermediate transfer belt 6*a* is also movable in conjunction with the cleaning opposed roller 6*e*.

As the intermediate transfer belt 6*a*, for example, a belt based on a resin film or rubber having a thickness of from 50 μm to 600 μm is suitable. The intermediate transfer belt 6*a* has a resistance value that allows the toner image borne by each of the photoconductors 2 to be electrostatically transferred onto the outer circumferential surface of the intermediate transfer belt 6*a* by a bias applied to each of the primary transfer rollers 7. Note that, in the printer 500, the components associated with the intermediate transfer belt 6*a* are supported together with the intermediate transfer belt 6*a*, thus constructing the intermediate transfer device 6, which is attachable to and removable from the printer 500.

As an example of intermediate transfer belt, the intermediate transfer belt 6*a* is made of carbon-dispersed polyamide. The resistance of the intermediate transfer belt 6*a* is adjusted to a volume resistance value of from about $10^6$ Ωcm to about $10^{12}$ Ωcm. The intermediate transfer belt 6*a* is provided with a rib on one or each end portion of the intermediate transfer belt 6*a* to prevent the intermediate transfer belt 6*a* being skewed and keep stable rotation of the intermediate transfer belt 6*a*.

As an example of primary transfer roller, each of the primary transfer rollers 7 of the printer 500 includes a metal roller as a core and a conductive rubber material resting on the surface of the metal roller. A bias is applied to the metal roller (i.e., the core) from a power source. The conductive rubber material is. e.g., carbon-dispersed urethane rubber. The resistance of the conductive rubber material is adjusted to a volume resistance of about $10^5$ Ωcm. Alternatively, the primary transfer rollers 7 may be metal rollers having no rubber layer. A secondary transfer roller 14*a* is disposed on the outer circumference of the intermediate transfer belt 6*a* at a position opposite the roller 6*b* via the intermediate transfer belt 6*a*. The roller 6*b* is a support roller that supports the intermediate transfer belt 6*a* and hereinafter referred to as a secondary transfer opposed roller 6*b*. The secondary transfer roller 14*a* includes a metal roller as a core and a conductive rubber resting on the surface of the metal roller. A bias is applied to the metal roller (i.e., the core) from a power source 14*b*. Carbon is dispersed in the conductive rubber. The resistance of the conductive rubber is adjusted to a volume resistance of about $10^7$ Ωcm.

The secondary transfer roller 14*a* contacts the intermediate transfer belt 6*a* at the position opposite the secondary transfer opposed roller 6*b*, thus forming an area of contact, herein referred to as a secondary transfer nip, between the secondary transfer roller 14*a* and the intermediate transfer belt 6*a*. The secondary transfer nip serves as a secondary transfer portion. While a sheet S such as a transfer sheet (or paper) serving as a recording medium passes between the intermediate transfer belt 6*a* and the secondary transfer roller 14*a* at the secondary transfer nip, the bias is applied to the secondary transfer roller 14*a* to electrostatically transfer a toner image from the intermediate transfer belt 6*a* onto the sheet S.

Multiple input trays 9 (in this case, two input trays 9A and 9B) are disposed in the sheet feeding part 300 below the exposure device 80 such that the input trays 9A and 9B are drawn out. Pickup rollers 10A and 10B rotate to selectively send out the sheets S from the input trays 9A and 9B, respectively. The sheet S sent out from the input tray 9A is conveyed to a conveyance passage P1 via a separation roller pair 11A and a conveyance roller pair 12A. Similarly, the sheet S sent out from the input tray 9B is conveyed to the conveyance passage P1 via a separation roller pair 11B and a conveyance roller pair 12B.

A timing roller pair 13 is disposed on the conveyance passage P1 to adjust the time to feed the sheet S to the secondary transfer portion. Activation of the timing roller pair 13 is timed to send out the sheet S toward the secondary transfer nip between the intermediate transfer belt 6*a* and the secondary transfer roller 14*a* such that the sheet S meets the toner image on the intermediate transfer belt 6*a* at the secondary transfer nip.

The printer 500 includes a bypass tray 25 serving as a bypass feeder on the right side in FIG. 1. The bypass tray 25 is rotatable and storable in a side frame F, which is a part of the main body of the printer 500. A bypass pickup roller 26 feeds an uppermost sheet S resting on the bypass tray 25. In order to ensure that the uppermost sheet S is conveyed alone, a separating roller 27 as a separator separates, from the uppermost sheet S, other sheets conveyed together with the uppermost sheet S. A pair of conveyance rollers 22 and 24 sends out the uppermost sheet S to the timing roller pair 13 via the conveyance passage P1.

Above the secondary transfer nip is a fixing device 15 that includes a heater. The fixing device 15 of the printer 500 includes a fixing roller 15*a* and a pressure roller 15*b*. The fixing roller 15*a* includes a built-in heater. The pressure roller 15*b* contacts the fixing roller 15*a* while pressing the fixing roller 15*a*. The fixing device 15 is not limited to such a configuration. Alternatively, for example, the fixing device 15 may employ a belt. The fixing device 15 may employ an induction heating (IH) system.

A switching guide 63 is rotatable. The switching guide 63 in a state illustrated in FIG. 1 directs the sheet S bearing a fixed toner image to a guide 61*a* that defines a sheet ejection passage. As output rollers 62 rotates, the sheet S guided by the guide 61*a* is ejected as indicated by an arrow D in FIG. 1 onto an output tray 60, which is an upper portion of the printer 500. Thus, the plurality of sheets S rest on the output tray 60 as illustrated in FIG. 1.

The printer 500 illustrated in FIG. 1 includes a duplex-copy unit to automatically form an image on each side of the sheet S. The duplex-copy unit includes sheet re-feeding passages and rollers to reverse and re-feed the sheet S. Specifically, the duplex-copy unit includes a switchback passage P5 and a re-feeding passage P6 inside the side frame F. The duplex-copy unit further includes the switching guide 63 as a first switching guide, a second switching guide G2, and a third switching guide G3 to convey the sheet S bearing an image on one side to the conveyance passage P1.

The duplex-copy unit further includes, e.g., a reverse roller 18*a* and the roller 22 (hereinafter referred to as a reverse roller 22) coupled to a driving source and reversable (i.e., rotatable in forward and reverse directions) by control of the driving source. A roller 23 and the roller 24 contact the reverse roller 22. The reverse roller 22 rotates clockwise to send out the sheet S together with the roller 24 from the bypass tray 25. By contrast, the reverse roller 22 rotates counterclockwise to re-feed the sheet S together with the roller 23 from the re-feeding passage P6 toward the timing roller pair 13.

As the switching guide 63 rotates clockwise from the state illustrated in FIG. 1, the sheet S bearing the fixed toner image is guided to a reverse conveyance passage P4 by a roller pair 17, conveyed to a reverse roller pair 18 via the second switching guide G2, and temporarily sent to the switchback passage P5. After the sheet S is sent to the switchback passage P5, the reverse roller 18*a* of the reverse roller pair 18 rotates counterclockwise, thus rotating a roller 18*b* of the reverse roller pair 18. On the other hand, the second switching guide G2 rotates counterclockwise. Accordingly, the sheet S is sent from the switchback passage P5 to the re-feeding passage P6. Along the re-feeding passage P6, the sheet S is conveyed by a pair of rollers 15*c* and 20 and a pair of rollers 14*c* and 21 to the rollers 22 and 23 in pair (hereinafter referred to as a pair of rollers 22 and 23). The pair of rollers 22 and 23 sends out the sheet S to the timing roller pair 13.

In FIG. 1, the printer 500 includes a sheet feeder 50 below the sheet feeding part 300, as an additional sheet feeding part of the printer 500. The sheet feeder 50 serves as a sheet feeding device. Although the sheet feeder 50 includes two input trays 51 in FIG. 1, the sheet feeder 50 may include three or more input trays 51. The sheet feeder 50 may include a built-in input tray having an increased capacity.

In the printer 500, the third switching guide G3 is located downstream from the roller pair 17 in a sheet conveying direction in which the sheet S is conveyed. In other words, the third switching guide G3 is located above the fixing device 15 in FIG. 1. The third switching guide G3 rotates counterclockwise from the state illustrated in FIG. 1 to guide the sheet S bearing a fixed toner image so that the sheet S travels to a sheet ejection passage P3, through which the sheet S is ejected to an output device other than the output tray 60. The output device is, e.g., a bin tray assembly constructed of several output trays.

Now, a description is given of a single-sided printing operation of the printer 500 to form an image on one side of the sheet S.

First, the exposure device 80 emits the laser beam 8Y from the semiconductor laser to irradiate the surface of the photoconductor 2Y, which is uniformly charged by the charging roller 4*a*Y, with the laser beam 8Y according to yellow image data. Thus, the exposure device 80 forms an electrostatic latent image on the surface of the photoconductor 2Y. The developing roller 5*a*Y develops the electrostatic latent image with yellow toner, rendering the electrostatic latent image visible as a yellow toner image. The primary transfer roller 7Y primarily transfers the yellow toner image onto the outer circumferential surface of the intermediate transfer belt 6*a* rotating in synchronization with the photoconductor 2Y. Such latent image formation, development, and primary transfer operations are sequentially performed in the same manner for the other photoconductors 2C, 2M, and 2Bk.

In the primary transfer operation, the toner images of yellow (Y), cyan (C), magenta (M), and black (Bk) are sequentially superimposed one atop another on the outer circumferential surface of the intermediate transfer belt 6*a*, thus forming a four-color toner image (which may be referred to as a full-color toner image) on the outer circumferential surface of the intermediate transfer belt 6*a*. The four-color toner image is conveyed on the intermediate transfer belt 6*a* that rotates in the direction indicated by arrow in FIG. 1. On the other hand, the cleaner 3 removes residual toner and foreign matters from the surface of the photoconductor 2 passing through the position opposite the primary transfer roller 7 with the intermediate transfer belt 6*a* interposed between the photoconductor 2 and the primary transfer roller 7.

The secondary transfer roller 14*a* secondarily transfers the four-color toner image from the intermediate transfer belt 6*a* onto the sheet S, which is conveyed in synchronization with the intermediate transfer belt 6*a*. Thereafter, the belt cleaner 6*h* cleans the outer circumferential surface of the intermediate transfer belt 6*a* so that the intermediate transfer belt 6*a* is ready for the next image forming and transfer processes. The sheet S bearing the four-color toner image is conveyed to the fixing device 15, which fixes the toner image onto the sheet S. The output rollers 62 ejects the sheet S onto the output tray 60 with the image side of the sheet S bearing the fixed image facing down.

Now, a description is given of a double-sided printing operation of the printer 500 to form an image on each side of the sheet S.

In the same manner as in the single-sided printing operation described above, after the sheet S bearing an image transferred from the intermediate transfer belt 6*a* on one side, as a first side, of the sheet S passes through the fixing device 15, the switching guide 63 guides the sheet S toward the roller pair 17. Then, downstream from the roller pair 17 in the sheet conveying direction, the third switching guide G3 guides the sheet S to the reverse conveyance passage P4 so that the sheet S travels above the second switching guide G2 in a rotational position illustrated in FIG. 1 to the reverse roller pair 18, which sends out the sheet S to the switchback passage P5.

At this time, the reverse roller 18*a* is driven to rotate clockwise. A roller pair 19 disposed on the switchback passage P5 is a roller pair capable of rotating in forward and reverse directions. After temporarily receiving the sheet S in the switchback passage P5, the roller pair 19 reversely rotates to reverse the sheet S. When the rotational directions of the roller pair 19 and the reverse roller pair 18 are reversed, the second switching guide G2 rotates counterclockwise from the posture illustrated in FIG. 1 to guide the sheet S to the pair of rollers 15*c* and 20. At this time, the leading end of the sheet S is previously a trailing end of the sheet S before the sheet S enters the switchback passage P5. The pair of rollers 15*c* and 20 and the pair of rollers 14*c* and 21 convey the sheet S along the re-feeding passage P6 to the pair of rollers 22 and 23, which sends out the sheet S toward the timing roller pair 13 via the conveyance passage P1. Thereafter, the activation of the timing roller pair 13 is timed to send out the sheet S bearing the toner image fixed on the first side of the sheet S again toward the secondary transfer nip between the secondary transfer roller 14*a* and the intermediate transfer belt 6*a*. At the secondary transfer nip, another toner image is transferred from the intermediate transfer belt 6*a* onto the other side, as a second side, of the sheet S.

The image to be formed on the second side of the sheet S is formed in a series of image forming processes that starts when the sheet S is conveyed to a given position. The series of image forming processes in this case is also the same as the series of image forming processes in the single-sided printing operation to form the full-color toner image as described above. Thus, the intermediate transfer belt 6*a* bears the full-color toner image. However, since the sheet S is conveyed backwards in the switchback passage P5, the generation of image data according to which the exposure device 80 emits the laser beams 8 is controlled and executed so that the image is formed opposite in the sheet conveying direction, with respect to the image firstly formed.

After the full-color toner image is transferred from the intermediate transfer belt 6*a* onto the second side of the sheet S, the sheet S is conveyed to the fixing device 15, which fixes the full-color toner image onto the second side of the sheet S. Thereafter, the output rollers 62 ejects the sheet S onto the output tray 60. Note that, in the printer 500, several sheets S can be simultaneously conveyed along the conveying passages to increase the efficiency of double-sided image formation. A controller controls the timing of image formation on the front and back sides of the sheet S.

In the printer 500, since the toner image formed on the photoconductors 2 has a negative polarity, a positive charge is applied to the primary transfer roller 7 to transfer the toner image from the photoconductors 2 onto the outer circumferential surface of the intermediate transfer belt 6*a*. Similarly, a positive charge is applied to the secondary transfer roller 14*a* to transfer the toner image from the outer circumferential surface of the intermediate transfer belt 6*a* onto the sheet S.

Although the single-sided printing operation and the double-sided printing operation have been described in the example of performing full-color printing, some photoconductors 2 are not used in monochrome printing with black toner. Specifically, the photoconductors 2Y, 2M, and 2C are not used. In such monochrome printing with black toner, the photoconductors 2Y, 2M, and 2C and the developing devices 5Y, 5M, and 5C are not operated. The printer 500 includes a mechanism to keep the unused photoconductors 2Y, 2M, and 2C not in contact with the intermediate transfer belt 6*a*. In the printer 500, an internal frame 6*f* is supported rotatably about a frame shaft 6*g*. The internal frame 6*f* supports the roller 6*d* and the primary transfer rollers 7Y, 7C, and 7M.

At the time of monochrome printing, the internal frame 6*f* is rotated in a direction away from the photoconductors 2Y, 2M, and 2C, that is, in a clockwise direction in FIG. 1 so that the photoconductor 2Bk alone contacts the intermediate transfer belt 6*a*. In this state, the series of image forming processes is executed to form a monochrome image with black toner. In view of enhancing the life of the image forming stations 1Y, 1M, and 1C, it is advantageous to separate, from the intermediate transfer belt 6*a*, the photoconductors 2Y, 2M, and 2C of the image forming stations 1Y, 1M, and 1C that are not used at the time of monochrome printing and stop the photoconductors 2Y, 2M, and 2C and the developing devices 5Y, 5M, and 5C as described above.

In order to upkeep the printer 500 or replace parts of the printer 500, an exterior cover of the printer 500 is opened to perform a maintenance work. At the time of maintenance, in order to enhance the operability, the image forming station 1 may be replaced as a process cartridge that is a unit integrally supporting the components of the image forming station 1 illustrated in FIG. 1.

In a case in which the image forming station 1 illustrated in FIG. 1 is configured as a process cartridge, the image forming station 1 may be provided with a guide portion and a handle to facilitate the attachment and removal of the image forming station 1 to and from the printer 500. In addition, a storage device such as an integrated circuit (IC) tag may be provided to store the characteristics and operational state of the process cartridge. Such a storage device serves as a guide for maintenance and enhances the convenience in maintenance management of the process cartridge.

In order to upkeep the intermediate transfer device 6 or replace parts of the intermediate transfer device 6, the intermediate transfer belt 6*a* may be separated from each of the photoconductors 2 and drawn out from the printer 500.

Referring now to FIGS. 3 to 7, a detailed description is given of the sheet feeder 50 serving as a sheet feeding device used in the printer 500 of the present embodiment.

A feed and reverse roller (FRR) system and a motored reverse roller (MRR) system are known as general sheet separation systems of the sheet feeders. The sheet feeding devices employing these systems are common in including a feed roller and a reverse roller and in that a reverse torque of a given value or less is applied to the reverse roller. Specifically, the feed roller serves as a conveyance rotator that conveys a sheet in a sheet feeding direction, which may be referred to as a sheet conveying direction. The reverse roller serves as a separation rotator that sandwiches the sheet together with conveyance rotator. Since the reverse torque applied to the reverse roller is electrically controlled in the MRR system, the MRR system is more advantageous than the FRR system in simplifying the configuration and enhancing the durability and stability. Therefore, the sheet feeder 50 of the present embodiment employs the MRR system.

Figure 3:
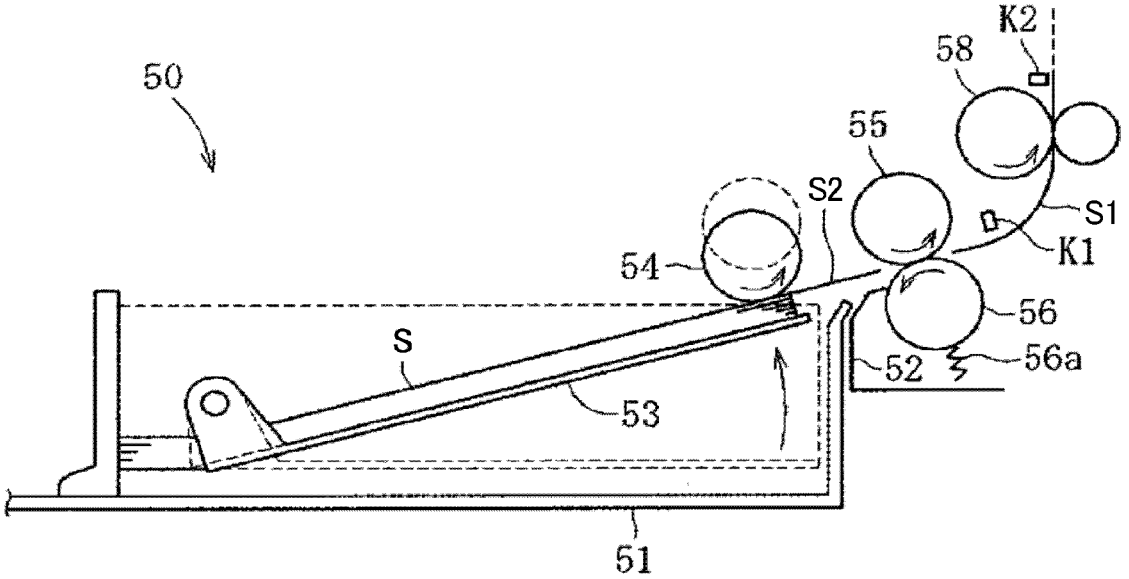
FIG. 3 is a schematic view of a sheet feeder according to an embodiment of the present disclosure.

FIG. 3 is a schematic view of the sheet feeder 50 according to the present embodiment.

As illustrated in FIG. 3, the sheet feeder 50 includes the input tray 51, a sheet guide 52, a bottom plate 53, a pickup roller 54, a feed roller 55, a reverse roller 56, a conveyance roller pair 58, and sheet detection sensors K1 and K2 serving as sheet detectors. The sheet feeder 50 further includes a spring 56*a*. A biasing force of the spring 56*a* presses the reverse roller 56 against the feed roller 55. A driving force is applied to the feed roller 55 to drive and rotate the feed roller 55 in the sheet feeding direction to feed the sheet S. On the other hand, a driving force (or reverse torque) is applied to the reverse roller 56 to drive and rotate the reverse roller 56 in a sheet reversing direction to reverse the sheet S. The pickup roller 54 coupled to the feed roller 55 through gears rotates to pick up and feed a sheet from a plurality of sheets S resting on the input tray 51. Specifically, the pickup roller 54 contacts the uppermost sheet (herein referred to as a preceding sheet S1) of the plurality of sheets S and feeds the preceding sheet S1 downstream in the sheet conveying direction. The feed roller 55 located downstream from the input tray 51 in the sheet conveying direction further conveys the preceding sheet S1 thus fed downstream in the sheet conveying direction.

Even before the trailing end of the preceding sheet S1 passes by the pickup roller 54, when the leading end of the preceding sheet S1 reaches the conveyance roller pair 58 located downstream from the feed roller 55 in the sheet conveying direction, the pickup roller 54 is separated from the surface of the preceding sheet S1 (or the pickup roller 54 is not driven). In response to the leading end of the preceding sheet S1 being detected by the sheet detection sensor K2 located downstream from the conveyance roller pair 58 in the sheet conveying direction, the pickup roller 54 is brought into contact with the surface of the uppermost sheet (herein referred to as a following sheet S2) of the plurality of sheets S resting on the input tray 51 (or the pickup roller 54 is driven again) to feed the following sheet S2.

On the other hand, in order to prevent a sheet jam, the driving of the feed roller 55 is stopped before the trailing end of the preceding sheet S1 reaches the feed roller 55. A one-way clutch is coupled to the shaft of the feed roller 55. Accordingly, even when the driving of the feed roller 55 is stopped, the feed roller 55 is rotated by the sheet conveyed by the conveyance roller pair 58 in the sheet conveying direction. Even when the leading end of the following sheet S2 reaches an area of contact, herein referred to as a separation nip, between the feed roller 55 and the reverse roller 56 in a manner following the trailing end of the preceding sheet S1, the sheet separation is reliably performed because the driving of the feed roller 55 is stopped and the reverse roller 56 rotates backwards to reverse the sheet S, thus preventing a sheet jam that may be caused by the loss of control of the interval between the preceding sheet S1 and the following sheet S2.

The following sheet S2 is fed in response to the leading end of the preceding sheet S1 being detected by the sheet detection sensor K2 located at a position downstream from the conveyance roller pair 58 in the sheet conveying direction where the behavior of the sheet S is stabilized (because the slip ratio is reduced). That is, in response to such detection, the driving of the pickup roller 54 and the feed roller 55 starts at a given time to satisfy a given printing productivity without the following sheet S2 colliding with the trailing end of the preceding sheet S1.

Now, a description is given of a separation operation according to the present embodiment.

Until the sheet S fed by the pickup roller 54 reaches the separation nip between the feed roller 55 and the reverse roller 56, the feed roller 55 is driven to rotate in the sheet conveying direction while the reverse roller 56 in contact with the feed roller 55 is rotated by the rotation of the feed roller 55 against the applied reverse torque. In a case in which a single sheet S enters the separation nip, the feed roller 55 continues rotating to convey the sheet S in the sheet conveying direction while the reverse roller 56 also continues rotating along with the feed roller 55 via the sheet S conveyed. Accordingly, a single sheet S is conveyed toward the conveyance roller pair 58.

By contrast, in a case in which two or more overlapping sheets S enter the separation nip, the feed roller 55 continues rotating to convey the uppermost sheet S alone in contact with the feed roller 55 in the conveying direction. On the other hand, since the reverse roller 56 contacts the rest of the sheets S, the reverse torque starts driving the reverse roller 56 to rotate in a direction opposite a direction in which the reverse roller 56 is rotated by the rotation of the feed roller 55 via the sheet S conveyed in the sheet feeding direction. Accordingly, the rest of the sheets S is separated from the single sheet S in contact with the feed roller 55 and reversed toward the input tray 51. As a result, the single sheet S is conveyed toward the conveyance roller pair 58.

Here, in a case in which two or more overlapping sheets S enter the separation nip, the rotational direction of the reverse roller 56 is changed to the sheet reversing direction opposite the sheet conveying direction from the sheet conveying direction in which the reverse roller 56 is rotated by the rotation of the feed roller 55 via the sheet S conveyed. At this time of change, the moment of inertia of the reverse roller 56 rotating in the direction in which the reverse roller 56 is rotated by the rotation of the feed roller 55 has some impacts together with the moment of inertia of various components rotating together with the reverse roller 56. An increased moment of inertia delays the reverse roller 56 to react and start the reverse rotation. The rest of the sheets S is sent downstream in the sheet conveying direction by the delay. As the amount by which the rest of the sheets S is sent downstream in the sheet conveying direction increases, it becomes more difficult to separate the rest of the sheets S from the single sheet S in contact with the feed roller 55 and reverse the rest of the sheets S toward the input tray 51. In order to prevent such a situation, the reverse roller 56 is desired to quickly react to keep the sheet separation and feeding stable.

Figure 4:
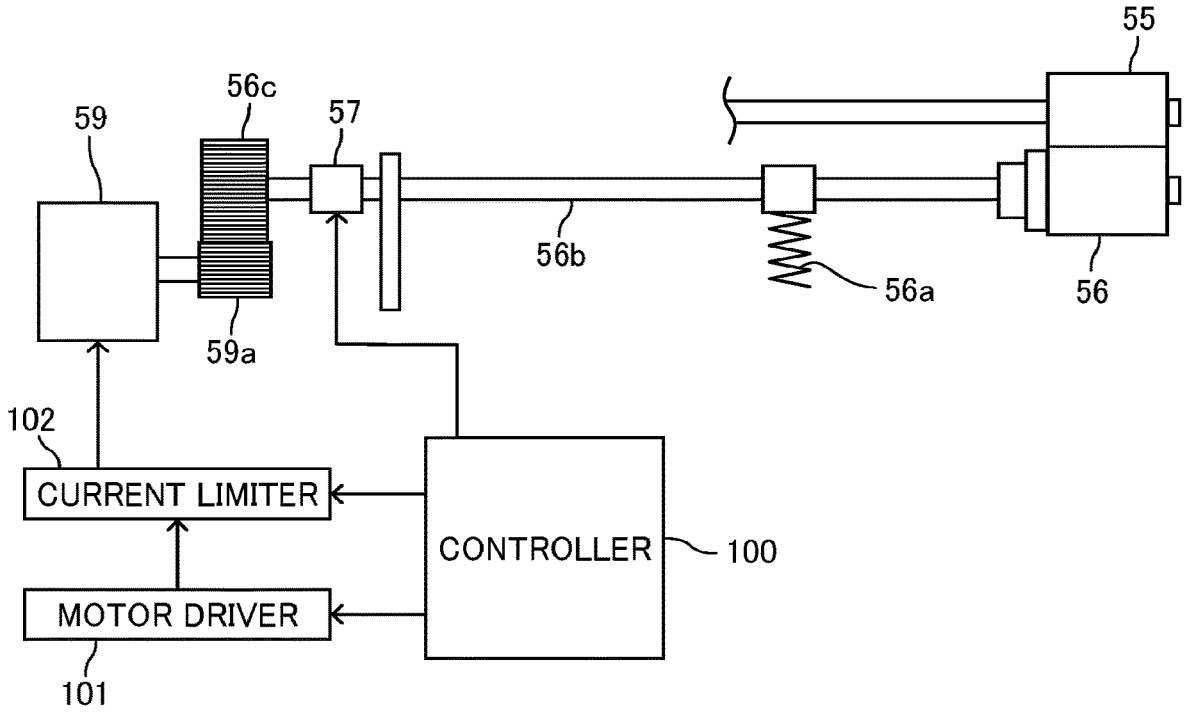
FIG. 4 is a schematic diagram of a driving mechanism of a feed roller and a reverse roller of the sheet feeder of FIG. 3.

FIG. 4 is a schematic diagram of a driving mechanism of the feed roller 55 and the reverse roller 56 of the sheet feeder 50 according to the present embodiment.

As illustrated in FIG. 4, a drive gear 56*c* of a roller shaft 56*b* of the reverse roller 56 meshes with a motor gear 59*a* of the reverse motor 59, which is a driving source serving as a torque applier that applies the reverse torque to the reverse roller 56. A driving current is input to the reverse motor 59, via a current limiter 102, from a motor driver 101 that operates under the control of a controller 100. The reverse motor 59 generates a torque corresponding to the amount of the input driving current to drive the motor gear 59*a*.

The current limiter 102 limits the amount of the driving current input to the reverse motor 59 to a given amount (i.e., the upper limit of the driving current) or less. The upper limit of the driving current is set to a value sufficient to generate a reverse torque that allows, when a single sheet enters the separation nip, the reverse roller 56 to rotate along with the feed roller 55 to convey the single sheet and that allows, when two or more sheets enter the separation nip, the reverse roller 56 to rotate in the sheet reversing direction to reverse excess sheets other than one of the sheets, the one being in contact with the feed roller 55. The upper limit of the driving current is changeable by the controller 100.

Here, in the sheet feeder 50 of the present embodiment, a clutch 57 serving as a torque transmission switcher is disposed on a torque transmission path between the reverse motor 59 and the reverse roller 56. Specifically, in the present embodiment, the clutch 57 is disposed on the roller shaft 56*b* between the reverse roller 56 and the drive gear 56*c*.

Since a typical configuration does not include the clutch 57, the reverse roller 56 and the reverse motor 59 are directly linked to each other via the motor gear 59*a*, the drive gear 56*c*, and the roller shaft 56*b*. In this typical configuration, the reverse roller 56 does not rotate alone. The reverse motor 59 and various components on the torque transmission path, such as the roller shaft 56*b*, the drive gear 56*c*, and the motor gear 59*a*, generate rotational motion together with the rotation of the reverse roller 56 until immediately before the rotational direction of the reverse roller 56 is changed when two or more sheets enter the separation nip.

Therefore, when the rotational direction of the reverse roller 56 is changed, the moment of inertia of the reverse roller 56 has some impacts together with the moment of inertia of the reverse motor 59 and the various components on the torque transmission path such as the roller shaft 56*b*, the drive gear 56*c*, and the motor gear 59*a*. That is, the moment of inertia is increased. Such an increased moment of inertia delays the reverse roller 56 to react and start the reverse rotation. As a result, the reverse roller 56 may fail to separate and reverse the excess sheets, resulting in multiple feeding.

By contrast, in the present embodiment, the clutch 57 is turned off to switch the state of the torque transmission path between the reverse motor 59 and the reverse roller 56 to a non-transmission state in which no torque is transmitted. In the non-transmission state, the reverse motor 59 and the components closer to the reverse motor 59 than the clutch 57, such as the drive gear 56*c* and the motor gear 59*a*, are separated from the rotational motion of the reverse roller 56 during rotation of the reverse roller 56 in the sheet conveying direction, that is, while the reverse roller 56 is rotated by the rotation of the feed roller 55.

Therefore, until immediately before the rotational direction of the reverse roller 56 is changed, the reverse motor 59 and the components closer to the reverse motor 59 than the clutch 57, such as the drive gear 56*c* and the motor gear 59*a*, rotate in the sheet reversing direction or do not rotate. When two or more sheets are interposed at the separation nip, the clutch 57 is turned on to switch the state of the torque transmission path from the non-transmission state to the transmission state. That is, only the component closer to the reverse roller 56 than the clutch 57 (specifically, part of the roller shaft 56*b*) rotates together with the reverse roller 56 in the sheet conveying direction when the rotational direction of the reverse roller 56 is reversed. In other words, in the present embodiment, the moment of inertia at the time when the rotational direction of the reverse roller 56 is reversed is smaller than that in the typical configuration described above. Accordingly, the reverse roller 56 quickly reacts and starts the reverse rotation in a shorter time than in the typical configuration. As a result, the reverse roller 56 quickly separates and reverses the excess sheets toward the input tray 51, thus preventing undesired multiple feeding.

Figure 5:
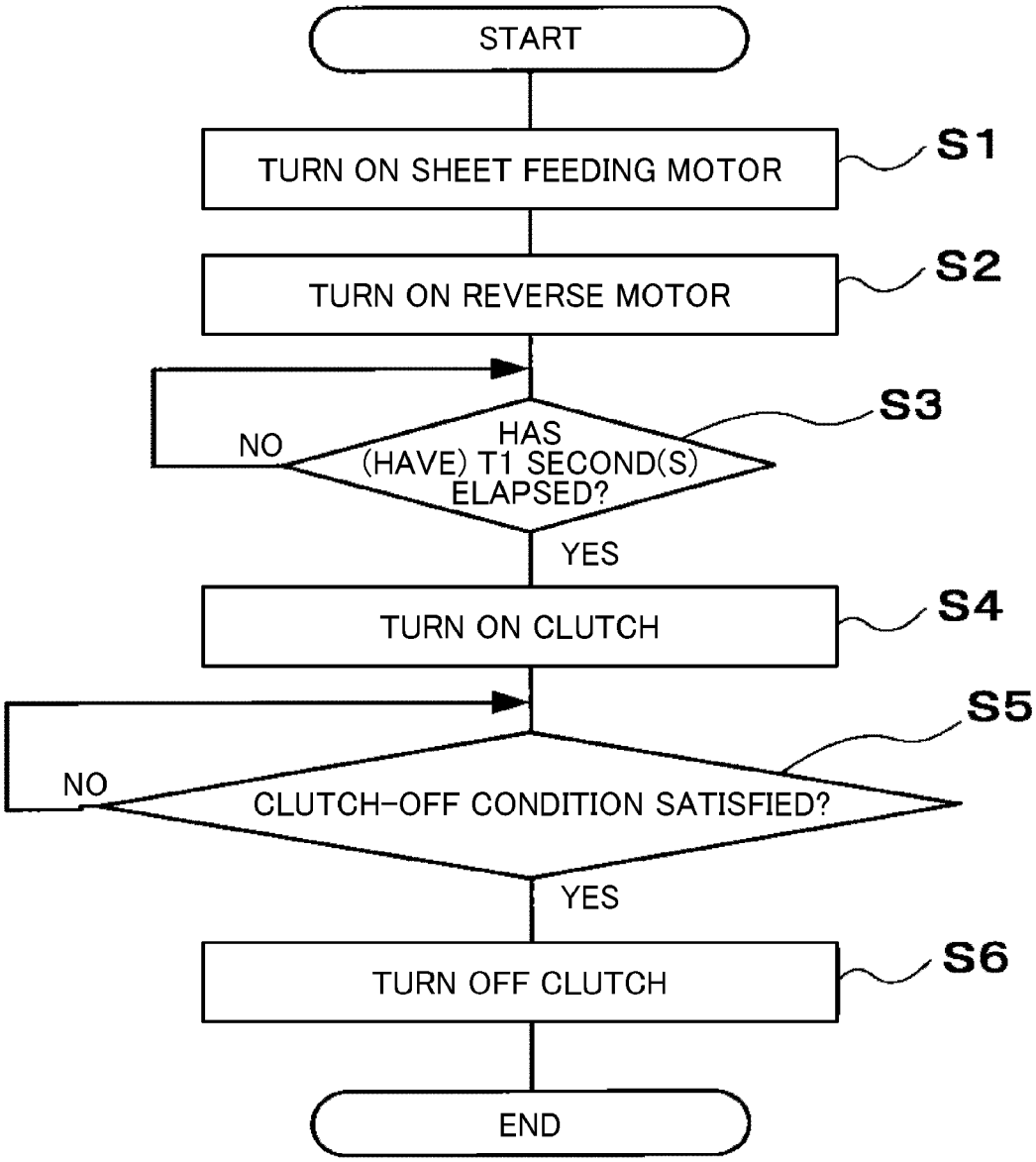
FIG. 5 is a flowchart of an outline of clutch control performed by a controller of the sheet feeder of FIG. 3.

Referring now to FIG. 5, a description is given of clutch control performed by the controller 100.

FIG. 5 is a flowchart of an outline of control of the clutch 57 performed by the controller 100.

The clutch 57 has been turned off at the time when the sheet feeding operation starts. In step S1, the controller 100 drives (or turns on) a sheet feeding motor to start driving the pickup roller 54 and the feed roller 55. The reverse roller 56 is rotated by the rotation of the feed roller 55. At this time, the reverse motor 59 may have been stopped or driven.

In step S2, the controller 100 drives (or turns on) the reverse motor 59 before the time when two or more sheets enter the separation nip comes, that is, before an elapse of T1 second(s) after the start of driving of the sheet feeding motor.

In step S3, the controller 100 determines whether T1 second(s) has (have) elapsed since the start of driving of the sheet feeding motor. When T1 second(s) has (have) not elapsed yet since the start of driving of the sheet feeding motor (NO in step S3), the controller 100 repeats the operation of step S3. By contrast, when T1 second(s) has (have) elapsed since the start of driving of the sheet feeding motor (YES in step S3), in step S4, the controller 100 turns on the clutch 57. Accordingly, the reverse torque is transmitted from the reverse motor 59 to the reverse roller 56 rotated by the rotation of the feed roller 55. When the clutch 57 is turned on, only the component closer to the reverse roller 56 than the clutch 57 (specifically, part of the roller shaft 56*b*) rotates together with the reverse roller 56 rotated by the rotation of the feed roller 55. In short, the moment of inertia at the time when the clutch 57 is turned on is relatively small. Therefore, in a case in which two or more sheets are sent to the separation nip, the reverse torque transmitted from the reverse motor 59 drives the reverse roller 56 to quickly react and shortly rotate in the reverse direction (i.e., the sheet reversing direction). Accordingly, the reverse roller 56 quickly separates and reverses the excess sheets toward the input tray 51, thus preventing undesired multiple feeding.

In step S5, the controller 100 determines whether a given clutch-off condition is satisfied. When the given clutch-off condition is not satisfied (NO in step S5), the controller 100 repeats the operation of step S5. By contrast, when the given clutch-off condition is satisfied (YES in step S5), in step S6, the controller 100 turns off the clutch 57. After the clutch 57 is turned off, the reverse motor 59 may be driven continuously or stopped.

The given clutch-off condition is settable as appropriate. For example, the given clutch-off condition may be a condition that a given time T2 (seconds; T2>T1) has elapsed since the start of driving of the sheet feeding motor. In this case, T2 corresponds to the time when the trailing end of the sheet S passes through the separation nip, for example. The value of T2 changes depending on the type of sheets different in length in the sheet conveying direction. To address such a situation, according to a data table of Table 1 below, for example, the controller 100 controls when to turn off the clutch 57 with the optimum value of T2 for each type of sheets different in length in the sheet conveying direction.

TABLE 1

| TYPE AND SIZE OF SHEET | TIME T1[S] TO TURN ON CLUTCH | TIME T2[S] TO TURN OFF CLUTCH |
|---|---|---|
| SHEET 1, A4 | . . . | . . . |
| SHEET 1, A3 | . . . | . . . |
| SHEET 2, A4 | . . . | . . . |
| SHEET 2, A3 | . . . | . . . |
| SHEET 2, LETTER SIZE | . . . | . . . |

Note that the optimum value of the time (i.e., T1) when the clutch 57 is turned on may also change depending on the type of sheets different in length in the sheet conveying direction. To address such a situation, the data table of Table 1 includes, as time T1, the time when the clutch 57 is turned on. The controller 100 controls when to turn on the clutch 57 with the optimum value of T1 for each type of sheets different in length in the sheet conveying direction.

It is not particularly limited how to determine the type of the sheet sent to the separation nip. In the present embodiment, as illustrated in FIG. 1, an operation panel 501 is provided as an input receiver through which, e.g., a user inputs the type of the sheets S loaded for each of the input trays 9A, 9B, and 51. Based on the information input by, e.g., the user, the controller 100 determines the type of the sheets S (i.e., the length of the sheets S in the sheet conveying direction) for each of the input trays 9A, 9B, and 51.

The given clutch-off condition may be, e.g., a condition that the sheet detection sensor K1 detects no sheet (i.e., the trailing end of the sheet conveyed from the separation nip passes by the sheet detection sensor K1). In other words, when the sheet detection sensor K1 detects no sheet (i.e., when the trailing end of the sheet conveyed from the separation nip passes by the sheet detection sensor K1), the controller 100 turns off the clutch 57.

Now, a description is given of a comparison of the power consumption of the sheet feeder 50 in the present embodiment and the power consumption of a comparative sheet feeder having a typical configuration in which the reverse roller 56 and the reverse motor 59 are directly linked to each other via the motor gear 59*a*, the drive gear 56*c*, and the roller shaft 56*b* without the clutch 57.

Figure 6A:
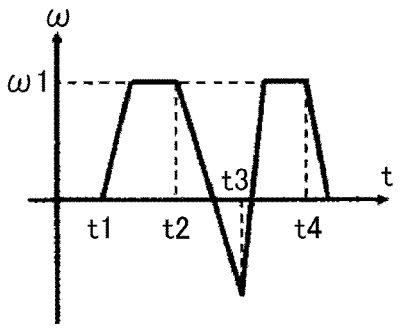
FIG. 6A is a graph of changes over time in rotational speed of a reverse roller in a case in which two or more sheets are sent to a separation nip in a typical configuration.
Figure 6B:
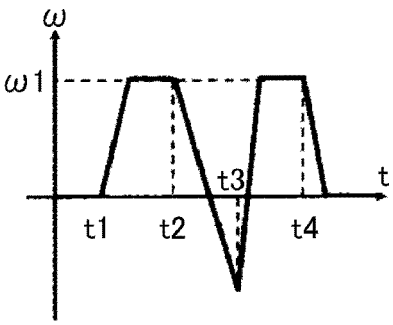
FIG. 6B is a graph of changes over time in rotational speed of a reverse motor in a case in which two or more sheets are sent to the separation nip in the typical configuration.
Figure 6C:
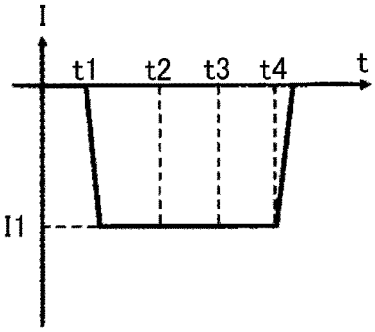
FIG. 6C is a graph of changes over time in value of a driving current input to the reverse motor in a case in which two or more sheets are sent to the separation nip in the typical configuration.

FIG. 6A is a graph of changes over time in rotational speed of the reverse roller 56 in a case in which two or more sheets are sent to the separation nip in the typical configuration. FIG. 6B is a graph of changes over time in rotational speed of the reverse motor 59 in a case in which two or more sheets are sent to the separation nip in the typical configuration. FIG. 6C is a graph of changes over time in value of a driving current input to the reverse motor 59 in a case in which two or more sheets are sent to the separation nip in the typical configuration.

Figure 7A:
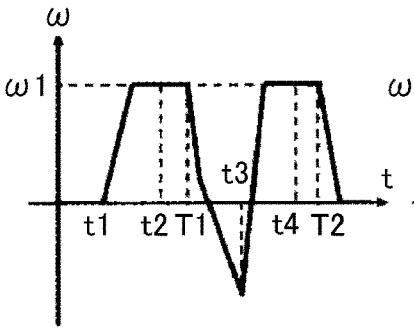
FIG. 7A is a graph of changes over time in rotational speed of a reverse roller in a case in which two or more sheets are sent to a separation nip according to an embodiment of the present disclosure.
Figure 7B:
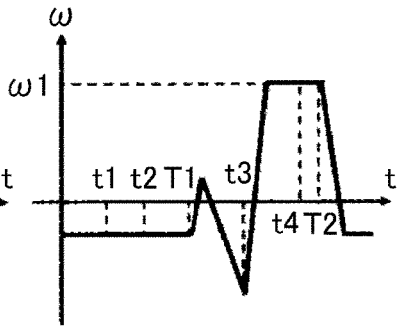
FIG. 7B is a graph of changes over time in rotational speed of a reverse motor in a case in which two or more sheets are sent to the separation nip according to the embodiment of FIG. 7A.
Figure 7C:
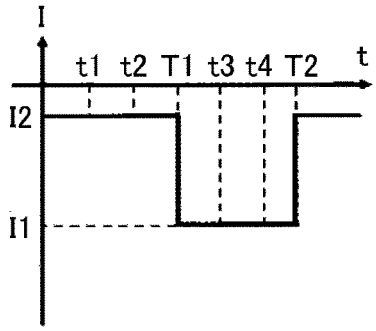
FIG. 7C is a graph of changes over time in value of a driving current input to the reverse motor in a case in which two or more sheets are sent to the separation nip according to the embodiment of FIG. 7A.

FIG. 7A is a graph of changes over time in rotational speed of the reverse roller 56 in a case in which two or more sheets are sent to the separation nip according to the present embodiment. FIG. 7B is a graph of changes over time in rotational speed of the reverse motor 59 in a case in which two or more sheets are sent to the separation nip according to the present embodiment. FIG. 7C is a graph of changes over time in value of a driving current input to the reverse motor 59 in a case in which two or more sheets are sent to the separation nip according to the present embodiment.

In the typical configuration, the reverse roller 56 supplied with the reverse torque from the reverse motor 59 is rotated by the rotation of the feed roller 55 via the sheet against the reverse torque during a period from a time t1 at which the driving of the sheet feeding motor (and the reverse motor 59) starts to a time t2 at which two or more sheets enter the separation nip. Therefore, as illustrated in FIG. 6A, the rotational speed of the reverse roller 56 is a target rotational speed ω1, equal to the rotational speed of the feed roller 55 that is driven to rotate constantly at the target rotational speed ω1, during the period from the time t1 at which the driving of the sheet feeding motor (and the reverse motor 59) starts to the time t2 at which the two or more sheets enter the separation nip.

When the two or more sheets enter the separation nip at the time t2, the rotational direction of the reverse roller 56 is changed, by the reverse torque, to the sheet reversing direction to reverse the excess sheets in contact with the reverse roller 56 as illustrated in FIG. 6A. In short, the reverse roller 56 is driven to rotate in the reverse direction. Thereafter, at a time t3 at which all the excess sheets of the two or more sheets entering the separation nip are reversed, the reverse roller 56 changes the rotational direction again and rotates along with the feed roller 55 via the sheet. Thus, as illustrated in FIG. 6A, the rotational speed of the reverse roller 56 becomes equal to the target rotational speed ω1 of the feed roller 55. Thereafter, the driving of the feed roller 55 is stopped at a time t4. Although the reverse motor 59 may be driven continuously or stopped, the reverse motor 59 is driven continuously as illustrated in FIG. 7C in the present embodiment.

In the typical configuration, since the reverse roller 56 and the reverse motor 59 are directly linked to each other, the rotational speed of the reverse motor 59 illustrated in FIG. 6B is equal to the rotational speed of the reverse roller 56 illustrated in FIG. 6A. Since the load exceeding the limiter is applied to the reverse motor 59, the driving current is input to the reverse motor 59 constantly at a current value I1, which is an upper limit current value. By contrast, in the present embodiment, as illustrated in FIG. 7A, the reverse roller 56 is rotated by the rotation of the feed roller 55 via the sheet until the clutch 57 is turned on T1 second(s) after the start of driving of the sheet feeding motor at the time t1. When the clutch 57 is turned on after the time t2 at which two or more sheets enter the separation nip, that is, when the clutch 57 is turned on T1 second(s) after the start of driving of the sheet feeding motor, the reverse torque is applied from the reverse motor 59 to the reverse roller 56.

Accordingly, as illustrated in FIG. 7A, the rotational direction of the reverse roller 56 is changed, by the reverse torque, to the sheet reversing direction to reverse the excess sheets in contact with the reverse roller 56. In short, the reverse roller 56 is driven to rotate in the reverse direction. Thereafter, when all the excess sheets of the two or more sheets entering the separation nip are reversed at the time t3, the reverse roller 56 changes the rotational direction again and rotates along with the feed roller 55 via the sheet. Thus, as illustrated in FIG. 7A, the rotational speed of the reverse roller 56 becomes equal to the target rotational speed ω1 of the feed roller 55.

In the present embodiment, since the clutch 57 is turned off during a period from the time t1 at which the driving of the sheet feeding motor starts to the time when T1 second(s) has (have) elapsed and the clutch 57 is turned on, the reverse motor 59 is in a state in which the reverse torque is idle as illustrated in FIG. 7B. In the present embodiment, the reverse motor 59 is driven before the start of driving of the sheet feeding motor. Alternatively, however, the reverse motor 59 may be driven at any time before the clutch 57 is turned on, that is, before T1 second(s) has (have) elapsed since the time t1. Since the reverse motor 59 is in such a state, the driving current is input to the reverse motor 59 at a current value I2 lower than the upper limit current value, that is, the current value I1.

Thus, the present embodiment reduces the driving current value during the period from the time t1 at which the driving of the sheet feeding motor (and the reverse motor 59) starts to the time when T1 second(s) has (have) elapsed and the clutch 57 is turned on. In short, the present embodiment reduces the power consumption compared to the typical configuration.

Referring now to FIGS. 8 to 11C, a description is given of a first variation of clutch control (i.e., the control of the clutch 57) described in the embodiment described above.

In the first variation, the controller 100 determines the clutch-off condition for turning off the clutch 57, based on a rotational speed w (i.e., rotational information) of the reverse roller 56, in order to further reduce the driving current input to the reverse motor 59 to reduce the power consumption.

Figure 8:
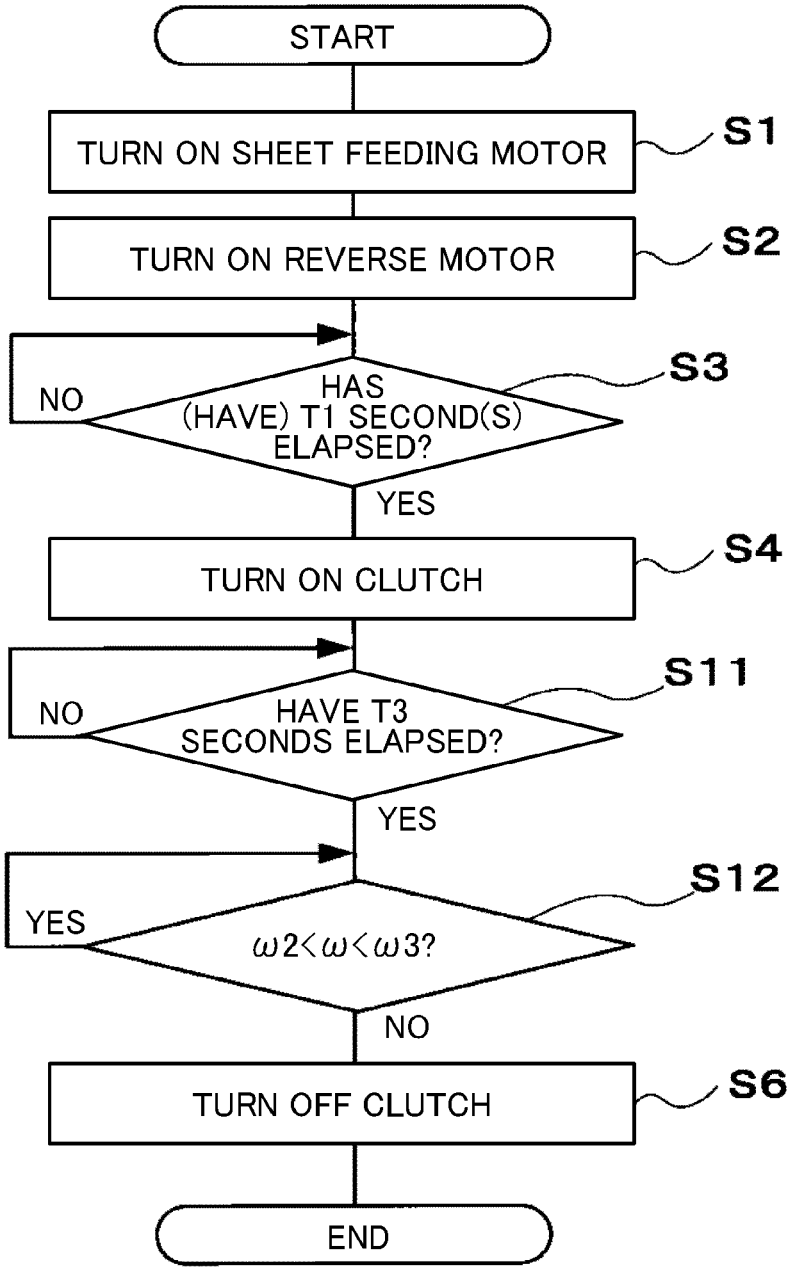
FIG. 8 is a flowchart of clutch control according to a first variation.

FIG. 8 is a flowchart of the control of the clutch 57 according to the first variation. In steps S1 and S2, the controller 100 starts driving (or turns on) the sheet feeding motor and the reverse motor 59, respectively. When T1 second(s) has (have) elapsed (YES in step S3), in step S4, the controller 100 turns on the clutch 57. In the first variation, as in the embodiment described above, when the clutch 57 is turned on, only the component closer to the reverse roller 56 than the clutch 57 (specifically, part of the roller shaft 56*b*) rotates together with the reverse roller 56 rotated by the rotation of the feed roller 55. Therefore, the moment of inertia is relatively small when the clutch 57 is turned on. Accordingly, the reverse roller 56 quickly separates and reverses the excess sheets toward the input tray 51, thus preventing undesired multiple feeding.

Figure 9:
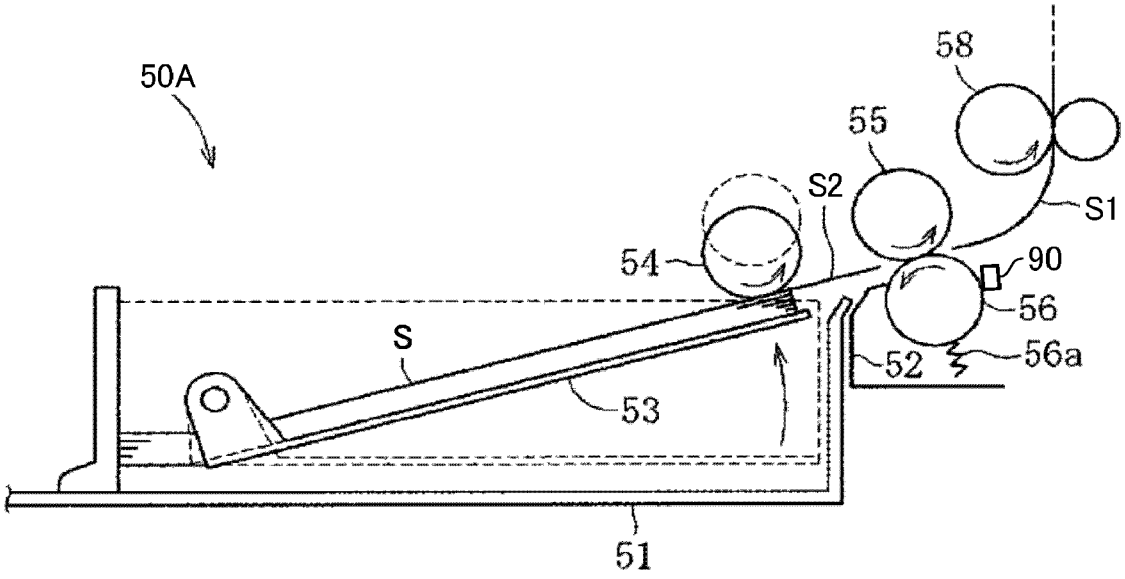
FIG. 9 is a schematic view of a sheet feeder according to the first variation.

FIG. 9 is a schematic view of a sheet feeder 50A according to the first variation.

As illustrated in FIG. 9, in the first variation, an encoder 90 is provided as a rotational speed measure or as a rotational information acquirer that measures the rotational speed co of the reverse roller 56 to acquire the rotational speed information as rotational information of the reverse roller 56. Information on the rotational speed co is output from the encoder 90 and input to the controller 100. The controller 100 determines when to turn off the clutch 57, based on the input information of the rotational speed co as follows.

Figure 10A:
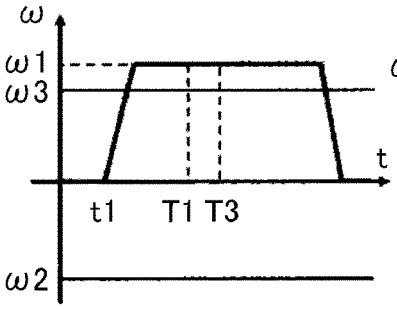
FIG. 10A is a graph of changes over time in rotational speed of a reverse roller in a case in which a single sheet is sent to a separation nip according to the first variation.
Figure 10B:
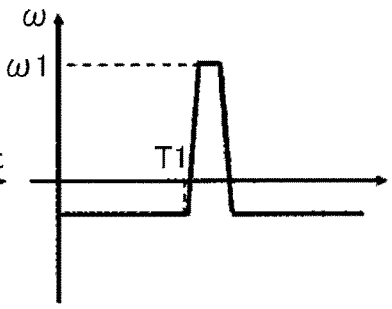
FIG. 10B is a graph of changes over time in rotational speed of a reverse motor in a case in which a single sheet is sent to the separation nip according to the first variation.
Figure 10C:
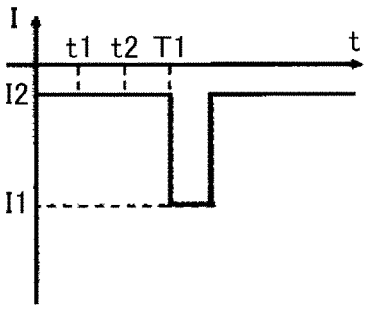
FIG. 10C is a graph of changes over time in value of a driving current input to the reverse motor in a case in which a single sheet is sent to the separation nip according to the first variation.

FIG. 10A is a graph of changes over time in rotational speed of the reverse roller 56 in a case in which a single sheet is sent to the separation nip according to the first variation. FIG. 10B is a graph of changes over time in rotational speed of the reverse motor 59 in a case in which a single sheet is sent to the separation nip according to the first variation. FIG. 10C is a graph of changes over time in value of a driving current input to the reverse motor 59 in a case in which a single sheet is sent to the separation nip according to the first variation.

Figure 11A:
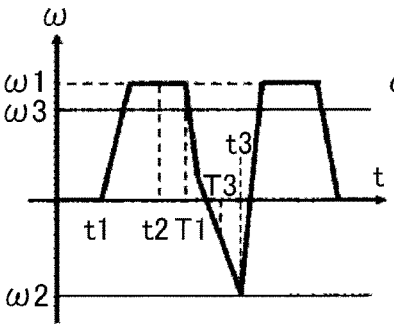
FIG. 11A is a graph of changes over time in rotational speed of the reverse roller in a case in which two or more sheet are sent to the separation nip according to the first variation.
Figure 11B:
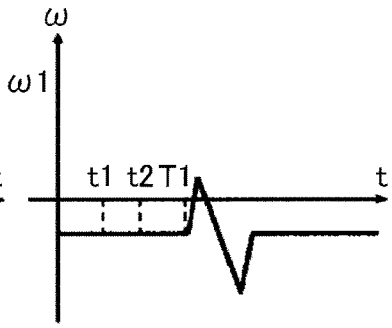
FIG. 11B is a graph of changes over time in rotational speed of the reverse motor in a case in which two or more sheets are sent to the separation nip according to the first variation.
Figure 11C:
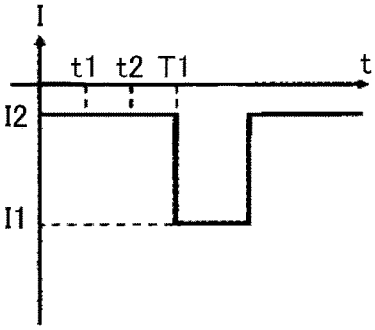
FIG. 11C is a graph of changes over time in value of the driving current input to the reverse motor in a case in which two or more sheets are sent to the separation nip according to the first variation.

FIG. 11A is a graph of changes over time in rotational speed of the reverse roller 56 in a case in which two or more sheet are sent to the separation nip according to the first variation. FIG. 11B is a graph of changes over time in rotational speed of the reverse motor 59 in a case in which two or more sheets are sent to the separation nip according to the first variation. FIG. 11C is a graph of changes over time in value of the driving current input to the reverse motor 59 in a case in which two or more sheets are sent to the separation nip according to the first variation.

In a case in which a single sheet is sent to the separation nip, the reverse roller 56 is rotated by the rotation of the feed roller 55 via the sheet until the sheet passes through the separation nip. Therefore, as illustrated in FIG. 10A, the rotational speed ω of the reverse roller 56 becomes equal to the target rotational speed ω1 as the feed roller 55 is driven to rotate constantly at the target rotational speed ω1 after the start of driving of the sheet feeding motor at the time t1. Then, the driving of the feed roller 55 is stopped. Although the reverse motor 59 may be driven continuously or stopped, the reverse motor 59 is driven continuously as illustrated in FIG. 10C in the first variation, as in the embodiment described above.

In the first variation, as described above, when the clutch 57 is turned on T1 second(s) after the start of driving of the sheet feeding motor at the time t1 (in steps S1 to S4 in FIG. 8), the reverse torque is applied from the reverse motor 59 to the reverse roller 56. Since the single sheet is interposed at the separation nip, the reverse roller 56 continues rotating along with the feed roller 55 via the sheet.

By contrast, in a case in which two or more sheets are sent to the separation nip, as illustrated in FIG. 11A, the reverse roller 56 is rotated by the rotation of the feed roller 55 via the sheet until the clutch 57 is turned on T1 second(s) after the start of driving of the sheet feeding motor at the time t1. When the clutch 57 is turned on T1 second(s) after the start of driving of the sheet feeding motor at the time t1 (in steps S1 to S4), the reverse torque is applied from the reverse motor 59 to the reverse roller 56. Accordingly, as illustrated in FIG. 11A, the rotational direction of the reverse roller 56 is changed, by the reverse torque, to the sheet reversing direction to reverse the excess sheets in contact with the reverse roller 56.

In short, the reverse roller 56 is driven to rotate in the reverse direction. Thereafter, when all the excess sheets of the two or more sheets entering the separation nip are reversed, the reverse roller 56 changes the rotational direction again and rotates along with the feed roller 55 via the sheet. Thus, as illustrated in FIG. 11A, the rotational speed of the reverse roller 56 becomes equal to the target rotational speed ω1 of the feed roller 55.

Now, a description is given of a comparison of FIG. 10A and FIG. 11A.

In a case in which a single sheet is sent to the separation nip, the rotational speed ω of the reverse roller 56 is substantially constant at the target rotational speed ω1 of the feed roller 55 as illustrated in FIG. 10A. By contrast, in a case in which two or more sheets are sent to the separation nip, as illustrated in FIG. 11A, the rotational speed ω of the reverse roller 56 decreases from the target rotational speed ω1 of the feed roller 55 while the two or more sheets are interposed at the separation nip (i.e., during a period from when the clutch 57 is turned on T1 second(s) after the start of driving of the sheet feeding motor to the time t3). Finally, the rotational speed ω3 of the reverse roller 56 reaches a reverse rotational speed ω2. Therefore, the controller 100 determines whether two or more sheets are interposed at the separation nip, based on the detection of the rotational speed ω3 of the reverse roller 56 in the aforementioned period (i.e., the period from the time when T1 second(s) has (have) elapsed since the time t1 to the time t3). In other words, based on the rotational speed w of the reverse roller 56, the controller 100 determines whether a single sheet is sent to the separation nip or whether multiple sheets are sent to the separation nip.

Specifically, in the first variation, in step S11 illustrated in FIG. 8, the controller 100 determines whether a time set around the middle of the aforementioned period (i.e., the period from the time when T1 second(s) has (have) elapsed since the time t1 to the time t3) has come. In short, the controller 100 determines whether T3 seconds have elapsed since the time t1. When T3 seconds have not elapsed yet since the time t1 (NO in step S11), the controller 100 repeats the operation of step S11. By contrast, when T3 seconds have elapsed since the time t1 (YES in step S11), in step S12, the controller 100 determines whether the rotational speed w of the reverse roller 56 is in a range greater than the rotational speed ω2 and smaller than a rotational speed ω3. As illustrated in FIG. 11A, the reverse roller 56 is driven, by the reverse torque, to rotate in the sheet reversing direction at the rotational speed ω2, which is the lower limit of the aforementioned range, in a case in which two or more sheets are sent to the separation nip. On the other hand, the rotational speed ω3, which is the upper limit of the aforementioned range, is lower than the rotational speed at which the reverse roller 56 is rotated by the rotation of the feed roller 55 in the sheet conveying direction (i.e., the target rotational speed ω1 of the feed roller 55). That is, the reverse roller 56 does not rotate at the rotational speed ω3 in a case in which a single sheet is sent to the separation nip. Therefore, when the rotational speed w of the reverse roller 56 is within the aforementioned range (i.e., ω2<ω<ω3), the controller 100 determines that two or more sheets are sent to the separation nip. By contrast, when the rotational speed ω is outside the aforementioned range (i.e., ω>ω3), the controller 100 determines that a single sheet is sent to the separation nip.

In the first variation, when T3 seconds have elapsed since the start of driving of the sheet feeding motor at the time t1 (YES in step S11), and when the rotational speed ω of the reverse roller 56 is outside the aforementioned range (ω2<ω<ω3) (NO in step S12), the controller 100 determines that a single sheet is sent to the separation nip. Immediately, in step S6, the controller 100 turns off the clutch 57. As a result, the reverse motor 59 is brought into a state in which the reverse torque is idle. The driving current is input to the reverse motor 59 at the current value I2, which is lower than the upper limit current value (i.e., the current value I1). Thus, in the first variation, the controller 100 turns off the clutch 57 earlier than in the embodiment described above. In addition, the value of the driving current input to the reverse motor 59 is changed to the lower value (i.e., the current value I2) earlier than in the embodiment described above. Accordingly, the power consumption is reduced. Note that the controller 100 may turn off the reverse motor 59 together with the clutch 57 to further reduce the power consumption.

In the first variation, when T3 seconds have elapsed since the start of driving of the sheet feeding motor at the time t1 (YES in step S11), and when the rotational speed ω of the reverse roller 56 is within the aforementioned range (ω2<ω<ω3) (YES in step S12), the controller 100 determines that two or more sheets are sent to the separation nip. In this case, the controller 100 does not immediately turned off the clutch 57. The controller 100 keeps the clutch 57 turned on until the rotational speed co of the reverse roller 56 deviates from the aforementioned range (i.e., ω2<ω<ω3). Accordingly, the reverse torque drives the reverse roller 56 to rotate in the sheet reversing direction to reverse the excess sheets in contact with the reverse roller 56 from the separation nip.

Thereafter, when all the excess sheets of the two or more sheets entering the separation nip are reversed, the reverse roller 56 is rotated by the rotation of the feed roller 55 via the sheet as illustrated in FIG. 11A. Therefore, the rotational speed ω of the reverse roller 56 becomes equal to the target rotational speed ω1 of the feed roller 55, which is greater than the rotational speed ω33. That is, the rotational speed ω3 of the reverse roller 56 deviates from the aforementioned range (i.e., ω2<ω<ω3) (NO in step S12). Then, as illustrated in FIG. 8, in step S6, the controller 100 turns off the clutch 57. As a result, the reverse motor 59 is brought into a state in which the reverse torque is idle. The driving current is input to the reverse motor 59 at the current value I2, which is lower than the upper limit current value (i.e., the current value I1).

In the embodiment described above, the controller 100 turns off the clutch 57 at the time when the given time T2 has elapsed since the start of driving of the sheet feeding motor at the time t1. The time T2 is generally a time sufficient to reliably reverse excess sheets out of two or more sheets sent in various states. In the first variation, the controller 100 turns off the clutch 57 based on the time when the excess sheets are reversed out of the two or more sheets sent in actual. Accordingly, in the first variation, the controller 100 turns off the clutch 57 earlier than in the embodiment described above. In addition, the value of the driving current input to the reverse motor 59 is changed to the lower value (i.e., the current value I2) earlier than in the embodiment described above. Thus, the power consumption is reduced. In addition, the controller 100 may turn off the reverse motor 59 after turning off the clutch 57 to further reduce the power consumption.

Referring now to FIGS. 12 to 14C, a description is given of a second variation of clutch control (i.e., the control of the clutch 57) described in the embodiment described above.

In the second variation, a multiple feeding detection sensor is disposed, downstream from the separation nip in the sheet conveying direction, as a multiple feeding detector that detects multiple feeding of sheets. The controller 100 controls the clutch 57 based on a result of detection made by the multiple feeding detection sensor.

Figure 12:
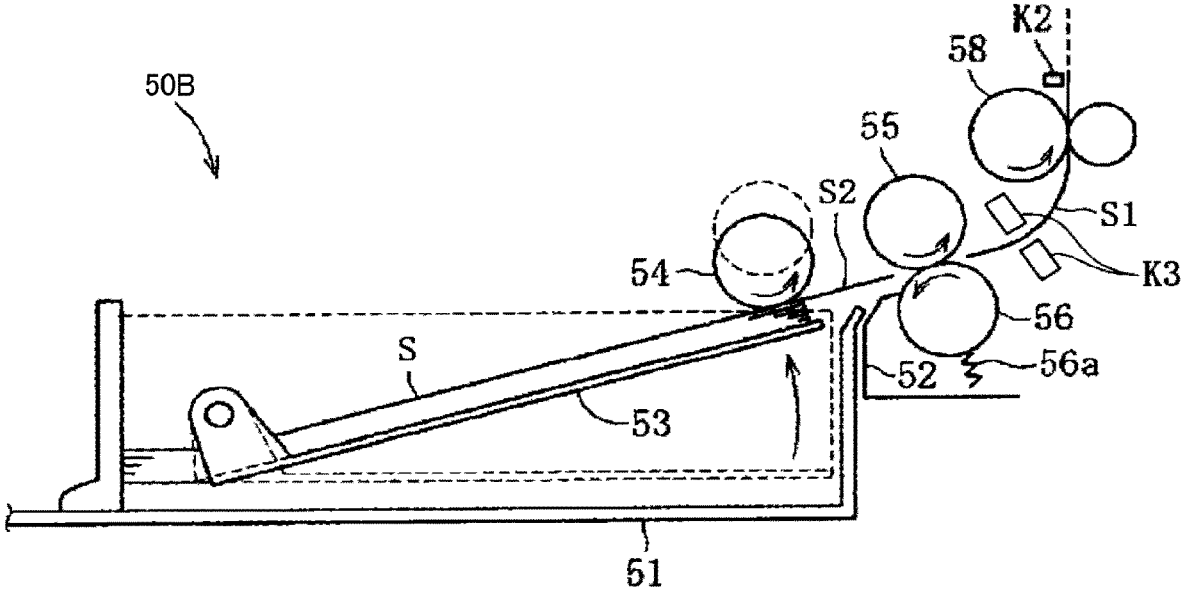
FIG. 12 is a schematic view of a sheet feeder according to a second variation.

FIG. 12 is a schematic view of a sheet feeder 50B according to the second variation.

In the second variation, instead of the sheet detection sensor K1, a multiple feeding detection sensor K3 is disposed downstream from the separation nip in the sheet conveying direction. The multiple feeding detection sensor K3 serves as a multiple feeding detector that detects multiple feeding of sheets. For example, the multiple feeding detection sensor K3 includes a light emitting unit and a light receiving unit disposed to sandwich the sheet conveyance passage. The multiple feeding detection sensor K3 determines whether a single sheet is conveyed or whether multiple sheets are conveyed, based on the difference in the amount of light transmitted through the sheet.

Figure 13:
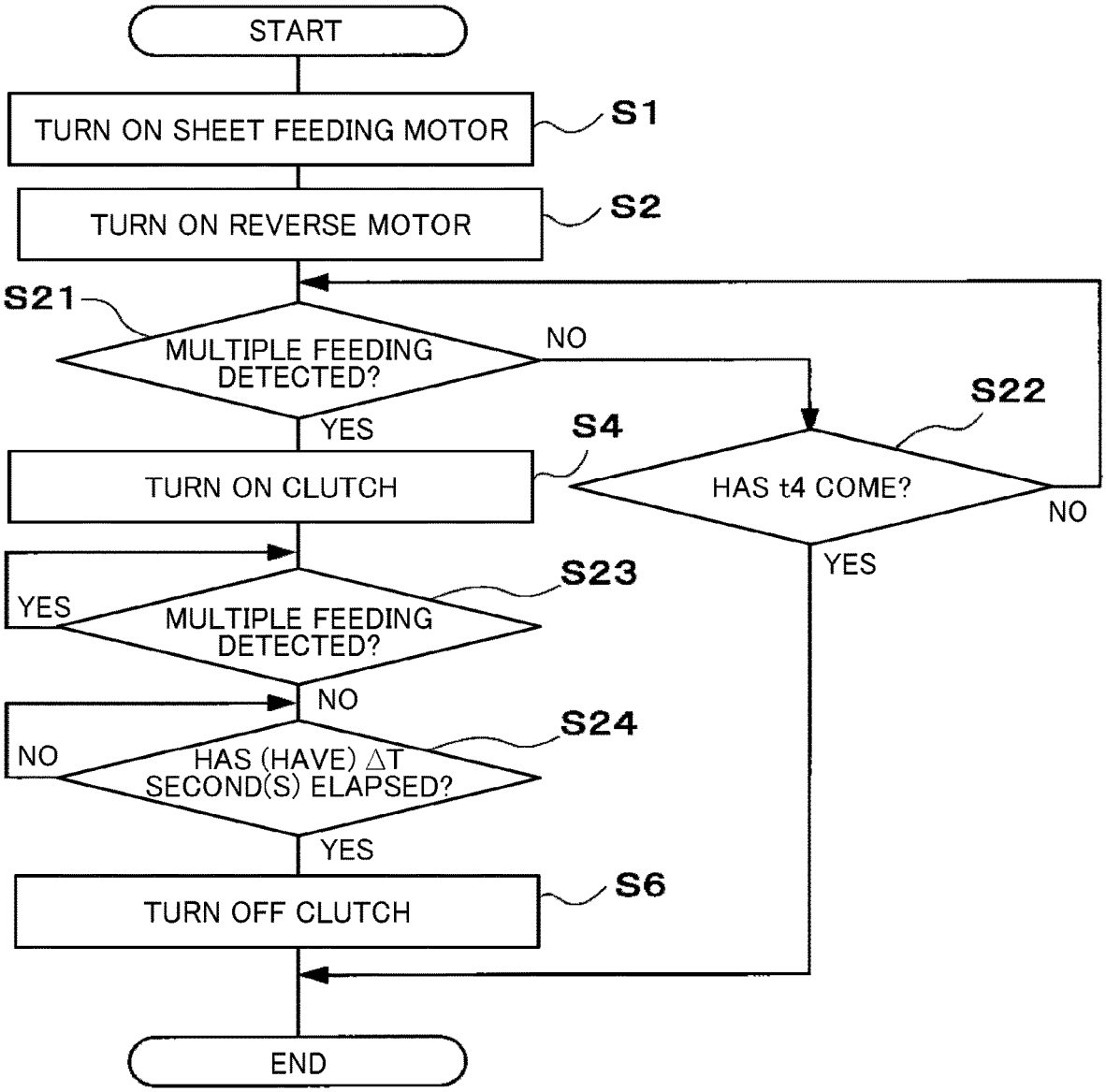
FIG. 13 is a flowchart of clutch control according to the second variation.

FIG. 13 is a flowchart of the control of the clutch 57 according to the second variation.

In the second variation, after starting to drive the sheet feeding motor and the reverse motor 59 in steps S1 and S2, respectively, in step S21, the controller 100 determines whether the multiple feeding detection sensor K3 detects multiple feeding. When the multiple feeding detection sensor K3 detects no multiple feeding (NO in step S21), in step S22, the controller 100 determines whether a given time t4 has come. The given time t4 is a time to stop the driving of the sheet feeding motor. When the time t4 has not come yet (NO in step S22), the process returns to step S21 and the controller 100 repeats the operation of step S21. By contrast, when the time t4 has come (YES in step S22), the controller 100 turns off the sheet feeding motor while keeping the clutch 57 turned off. Although the reverse motor 59 may be driven continuously or stopped, the reverse motor 59 is driven continuously in the second variation.

When the multiple feeding detection sensor K3 detects no multiple feeding, a single sheet is sent to the separation nip. That is, there is no need to apply the reverse torque from the reverse motor 59 to the reverse roller 56. In other words, there is no need to turn on the clutch 57. Therefore, in this case, the clutch 57 remains turned off until the single sheet passes through the separation nip. That is, the reverse motor 59 is in a state in which the reverse torque is idle. The driving current is input to the reverse motor 59 at the current value I2, which is lower than the upper limit current value (i.e., the current value I1). Thus, the second variation further reduces the power consumption, as compared with the embodiment and the first variation described above.

Figure 14A:
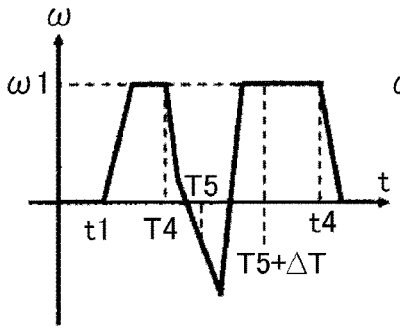
FIG. 14A is a graph of changes over time in rotational speed of a reverse roller in a case in which two or more sheet are sent to a separation nip according to the second variation.
Figure 14B:
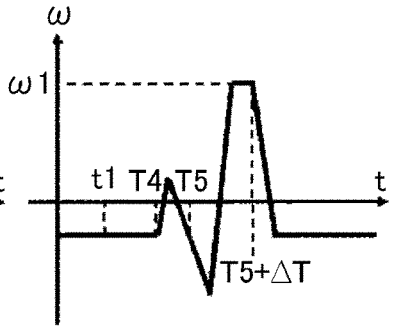
FIG. 14B is a graph of changes over time in rotational speed of a reverse motor in a case in which two or more sheets are sent to the separation nip according to the second variation.
Figure 14C:
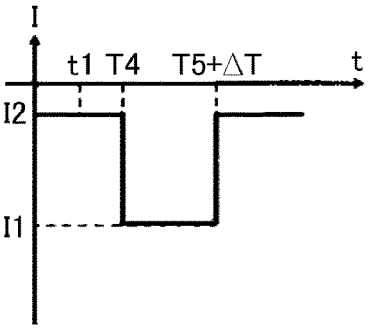
FIG. 14C is a graph of changes over time in value of a driving current input to the reverse motor in a case in which two or more sheets are sent to the separation nip according to the second variation.

FIG. 14A is a graph of changes over time in rotational speed of the reverse roller 56 in a case in which two or more sheet are sent to the separation nip according to the second variation. FIG. 14B is a graph of changes over time in rotational speed of the reverse motor 59 in a case in which two or more sheets are sent to the separation nip according to the second variation. FIG. 14C is a graph of changes over time in value of a driving current input to the reverse motor 59 in a case in which two or more sheets are sent to the separation nip according to the second variation.

Referring back to FIG. 13, when the multiple feeding detection sensor K3 detects the multiple feeding T4 seconds after the start of driving of the sheet feeding motor at the time t1 (YES in step S21), in step S4, the controller 100 turns on the clutch 57. In the second variation, as in the embodiment and the first variation described above, the moment of inertia is relatively small when the clutch 57 is turned on. Accordingly, the reverse roller 56 quickly separates and reverses the excess sheets toward the input tray 51, thus preventing undesired multiple feeding.

In step S23, the controller 100 determines whether the multiple feeding detection sensor K3 detects the multiple feeding T5 seconds after the start of driving of the sheet feeding motor at the time t1. When the multiple feeding detection sensor K3 detects the multiple feeding T5 seconds after the start of driving of the sheet feeding motor at the time t1 (YES in step S23), the controller 100 repeats the operation of step S23. By contrast, when the multiple feeding detection sensor K3 detects no multiple feeding T5 seconds after the start of driving of the sheet feeding motor at the time t1 (NO in step S23), in step S24, the controller 100 determines whether ΔT second(s) has (have) elapsed, specifically, whether T5 plus ΔT seconds have elapsed since the start of driving of the sheet feeding motor at the time t1. When ΔT second(s) has (have) not elapsed yet, specifically, when T5 plus ΔT seconds have not elapsed yet since the start of driving of the sheet feeding motor at the time t1 (NO in step S24), the controller 100 repeats the operation of S24. By contrast, when ΔT second(s) has (have) elapsed, specifically, T5 plus ΔT seconds have elapsed since the start of driving of the sheet feeding motor at the time t1 (YES in step S24), in step S6, the controller 100 turns off the clutch 57.

Preferably, the clutch 57 is turned off ΔT seconds after the multiple feeding detection sensor K3 detects no multiple feeding. Hereinafter, the ΔT seconds may be referred to as a given time ΔT. This is because, since the multiple feeding detection sensor K3 is distanced downstream from the separation nip in the sheet conveying direction, two or more sheets may be still interposed at the separation nip when the multiple feeding detection sensor K3 detects no multiple feeding. As the given time ΔT, an optimum time may be set in advance in consideration of, e.g., the distance between the separation nip and the multiple feeding detection sensor K3, the number of rotations of the reverse roller 56, and the torque set to the reverse motor 59.

In the embodiment described above, and in the first and second variations, the upper limit value of the driving current input to the reverse motor 59 remains unchanged. However, the magnitude of the reverse torque to reverse the excess sheets varies depending on the type of sheet. Examples of the type of sheet include, but are not limited to, the thickness, material, surface roughness, and size. Therefore, in a case in which the driving current input to the reverse motor 59 is reduced to reduce the power consumption, the upper limit value of the driving current input to the reverse motor 59 may be changed depending on the type of sheet. In this case, according to a data table of Table 2 below, for example, an optimum upper limit value of the drive current input to the reverse motor 59 may be used for each type of sheet.

TABLE 2

| TYPE AND SIZE OF SHEET | CURRENT VALUE I1 [A] OF REVERSE MOTOR WHEN CLUTCH IS TURNED ON | CURRENT VALUE I2 [A] OF REVERSE MOTOR WHEN CLUTCH IS TURNED OFF |
|---|---|---|
| SHEET 1, A4 | . . . | . . . |
| SHEET 1, A3 | . . . | . . . |
| SHEET 2, A4 | . . . | . . . |
| SHEET 2, A3 | . . . | . . . |
| SHEET 2, LETTER SIZE | . . . | . . . |

Note that the value of the driving current input to the reverse motor 59 differs between when the clutch 57 is turned on and when the clutch 57 is turned off. Therefore, the data table of Table 2 includes the current value I1 as the upper limit driving current value when the clutch 57 is turned on and the current value I2 as the upper limit driving current value when the clutch 57 is turned off. Thus, since the value of the drive current input when the clutch 57 is turned off is reduced, the power consumption is further reduced.

Although specific embodiments and variations are described, the embodiments and variations according to the present disclosure are not limited to those specifically described herein. Several aspects of the sheet feeding device are exemplified as follows.

Initially, a description is given of a first aspect.

According to the first aspect, a sheet feeding device (e.g., the sheet feeder 50) includes a conveyance rotator (e.g., the feed roller 55), a separation rotator (e.g., the reverse roller 56), a torque applier (e.g., the reverse motor 59), a torque controller or torque control circuit (e.g., the current limiter 102), and a torque transmission switcher (e.g., the clutch 57). The conveyance rotator is configured to convey a sheet (e.g., sheet S) in a sheet feeding direction. The separation rotator is configured to sandwich the sheet together with the conveyance rotator. The torque applier is configured to apply a reverse torque to the separation rotator in a sheet reversing direction to reverse the sheet. The torque controller is configured to control the reverse torque applied to the separation rotator to be equal to or less than a given value. The torque transmission switcher is configured to switch, between a transmission state and a non-transmission state, a state of a torque transmission path between the torque applier and the separation rotator. The transmission state is a state in which the reverse torque is transmitted. The non-transmission state is a state in which the reverse torque is not transmitted.

In the sheet feeding device, when two or more sheets are sent between the conveyance rotator and the separation rotator, the rotational direction of the separation rotator rotated by the rotation of the conveyance rotator is changed to the reverse direction by the reverse torque from the torque applier. Accordingly, the separation rotator separates, from one of the sheets, the one being in contact with the conveyance rotator, the rest of the sheets as excess sheets and reverses the excess sheets, thus allowing the one of the sheets to be conveyed in the sheet feeding direction.

By contrast, typical sheet feeding devices may fail to separate and reverse the excess sheets, resulting in multiple feeding. This is due to the following reasons.

When the rotational direction of the separation rotator is changed from the sheet feeding direction to the sheet reversing direction, that is, when the rotational direction of the separation rotator is changed from the direction in which the separation rotator is rotated by the rotation of the conveyance rotator to the reverse direction, the typical sheet feeding device is affected by the moment of inertia of the separation rotator rotating in the sheet feeding direction and various components rotating together with the separation rotator. This is because the reverse torque from the torque applier is transmitted to the separation rotator at all times. An increased moment of inertia delays the separation rotator to start the reverse rotation. The excess sheets are sent in the sheet feeding direction by the delay, hampering the separation and reverse conveyance of the excess sheets.

By contrast, in the sheet feeding device according to the present aspect, the torque transmission switcher switches the state of the torque transmission path between the torque applier and the separation rotator to the non-transmission state in which no torque is transmitted. In the non-transmission state, the torque applier and the components disposed closer to the torque applier than the torque transmission switcher on the torque transmission path are separated from the rotational motion of the separation rotator during rotation of the separation rotator in the sheet feeding direction, that is, while the separation rotator is rotated by the rotation of the conveyance rotator. Therefore, until immediately before the sheets are sent between the conveyance rotator and the separation rotator, the torque applier and the components closer to the torque applier than the torque transmission switcher on the torque transmission path rotate in the sheet reversing direction or do not rotate. The state of the torque transmission path is switched from the non-transmission state to the transmission state so that the separation rotator starts the reverse rotation at the time when two or more sheets are sent between the conveyance rotator and the separation rotator. At this time, the moment of inertia is smaller than the moment of inertia that affects the typical sheet feeding device in which the torque applier and the associated components have being rotating together with the separation rotator. Accordingly, in the sheet feeding device of the present aspect, the separation rotator starts the reverse rotation in a shorter time than in the typical sheet feeding device. As a result, the separation rotator quickly separates and reverses the excess sheets, thus preventing undesired multiple feeding.

Now, a description is given of a second aspect.

According to the second aspect, the sheet feeding device of the first aspect further includes a controller or circuitry (e.g., the controller 100) that is configured to cause the torque transmission switcher to switch the state of the torque transmission path from the non-transmission state to the transmission state at a time when the sheet is separable from at least one sheet conveyed together with the sheet between the conveyance rotator and the separation rotator (e.g., T1 second(s) after the start of driving the sheet feeding motor time t1).

According to the present aspect, the controller controls as appropriate the state of the torque transmission path between the torque applier and the separation rotator to the non-transmission state in which no torque is transmitted.

Now, a description is given of a third aspect.

According to the third aspect, the sheet feeding device of the second aspect further includes a sheet detector (e.g., the sheet detection sensor K1) that is configured to detect the sheet downstream from the separation rotator in the sheet feeding direction. The controller is configured to, after the torque transmission switcher switches the state of the torque transmission path from the non-transmission state to the transmission state, cause the torque transmission switcher to switch the state of the torque transmission path from the transmission state to the non-transmission state, based on a result of detection made by the sheet detector.

According to the present aspect, the torque transmission switcher switches the state of the torque transmission path from the transmission state to the non-transmission state at an appropriate time, that is, at the time when the sheet actually conveyed passes through a position downstream from the separation rotator in the sheet feeding direction.

Now, a description is given of a fourth aspect.

According to the fourth aspect, the sheet feeding device of the second or third aspect further includes a rotational information acquirer (e.g., the encoder 90) that is configured to acquire rotational information (e.g., the rotational speed co) of the separation rotator. The controller is configured to, after the torque transmission switcher switches the state of the torque transmission path from the non-transmission state to the transmission state, cause the torque transmission switcher to switch the state of the torque transmission path from the transmission state to the non-transmission state, based on the rotational information acquired by the rotational information acquirer.

According to the present aspect, the torque transmission switcher switches the state of the torque transmission path from the transmission state to the non-transmission state at an appropriate time, without the sheet detector. That is, even when it is difficult to dispose the sheet detector near the sheet conveyance passage, the torque transmission switcher switches the state of the torque transmission path from the transmission state to the non-transmission state at an appropriate time with the rotational information acquirer, instead of the sheet detector.

Now, a description is given of a fifth aspect.

According to the fifth aspect, in the sheet feeding device of any one of the second to fourth aspects, the controller is configured to, after the torque transmission switcher switches the state of the torque transmission path from the non-transmission state to the transmission state, cause the torque transmission switcher to switch the state of the torque transmission path from the transmission state to the non-transmission state, based on a type of the sheet including a length of the sheet in the sheet feeding direction.

According to the present aspect, since the controller estimates the time when the multiple feeding is solved from the type of the sheet conveyed (i.e., the length of the sheet in the sheet feeding direction), the torque transmission switcher switches the state of the torque transmission path from the transmission state to the non-transmission state at an appropriate time, without the sheet detector or the rotational information acquirer.

Now, a description is given of a sixth aspect.

According to the sixth aspect, the sheet feeding device of any one of the second to fifth aspects, further includes a multiple feeding detector (e.g., the multiple feeding detection sensor K3) that is configured to detect multiple feeding of sheets including the sheet downstream from the separation rotator in the sheet feeding direction. The controller is configured not to cause the torque transmission switcher to switch the state of the torque transmission path from the non-transmission state to the transmission state when the multiple feeding detector detects no multiple feeding.

According to the present aspect, when the multiple feeding does not occur, the sheet feeding is completed while the torque transmission path remains in the non-transmission state, without changing to the transmission state. That is, the present aspect eliminates the unnecessary application of the reverse torque to the separation rotator, thus reducing the power consumption.

Now, a description is given of a seventh aspect.

According to the seventh aspect, in the sheet feeding device of any one of the first to sixth aspects, the torque controller is configured to change a magnitude of the reverse torque applied by the torque applier, depending on the state of the torque transmission path switched between the non-transmission state and the transmission state.

There is no need to apply the same magnitude of the reverse torque when the state of the torque transmission path is in the non-transmission state as when the state of the torque transmission path is in the transmission state. In short, a smaller reverse torque is applied when the state of the torque transmission path is in the non-transmission state. Since an excessive reverse torque is not applied when the state of the torque transmission path is in the non-transmission state, the present aspect reduces the power consumption. Now, a description is given of an eighth aspect.

According to the eighth aspect, in the sheet feeding device of any one of the first to seventh aspects, the torque controller is configured to change a magnitude of the reverse torque applied by the torque applier, depending on a type of the sheet.

The magnitude of the reverse torque applied to the separation rotator to reverse the excess sheets varies depending on the type of the sheet. Examples of the type of the sheet include, but are not limited to, the thickness, material, surface roughness, and size. Since the reverse torque is applied as appropriate for the type of the sheet, an excessive reverse torque is not applied. Accordingly, the present aspect reduces the power consumption.

Now, a description is given of a ninth aspect.

According to the ninth aspect, the sheet feeding device of the fifth or eighth aspect further includes an input receiver (e.g., operation panel 501) that is configured to receive an input of the type of the sheet.

According to the present aspect, the type of the sheet is determined based on an instruction input by, e.g., a user.

Now, a description is given of a tenth aspect.

According to the tenth aspect, an image forming apparatus (e.g., the printer 500) includes an image forming device (e.g., the image forming part 200) that is configured to form an image on a sheet (e.g., the sheet S) and the sheet feeding device of any one of the first to ninth aspects, configured to feed the sheet to the image forming device.

The present aspect provides an image forming apparatus that separates sheets as appropriate and stably prevents undesired multiple feeding.

Now, a description is given of an eleventh aspect.

According to the eleventh aspect, a method for controlling a torque transmission switcher (e.g., the clutch 57) in a sheet feeding device (e.g., the sheet feeder 50) includes causing the torque transmission switcher to switch a state of a torque transmission path between a torque applier (e.g., the reverse motor 59) and a separation rotator (e.g., the reverse roller 56) from a non-transmission state to a transmission state at a time when a sheet (e.g., the sheet S) is separable from at least one sheet conveyed together with the sheet between a conveyance rotator (e.g., the feed roller 55) and the separation rotator. The transmission state is a state in which a torque is transmitted. The non-transmission state is a state in which the torque is not transmitted. The sheet feeding device includes the conveyance rotator, the separation rotator, the torque applier, a torque controller or torque control circuit (e.g., the current limiter 102), and the torque transmission switcher. The conveyance rotator is configured to convey the sheet in a sheet feeding direction. The separation rotator is configured to sandwich the sheet together with the conveyance rotator. The torque applier is configured to apply a reverse torque to the separation rotator in a sheet reversing direction to reverse the sheet. The torque controller is configured to control the reverse torque applied to the separation rotator to be equal to or less than a given value. The torque transmission switcher is configured to switch, between the transmission state and the non-transmission state, the state of the torque transmission path between the torque applier and the separation rotator.

The state of the torque transmission path is switched from the non-transmission state to the transmission state so that the separation rotator starts reverse rotation at the time when two or more sheets are sent between the conveyance rotator and the separation rotator. At this time, according to the method of the present aspect, the separation rotator starts the reverse rotation in a shorter time, compared to a typical separation rotator, to quickly separate and reverse the excess sheets, thus preventing undesired multiple feeding.

According to the embodiments of the present disclosure, the separation rotator separates the sheets as appropriate.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), a digital signal processor (DSP), a field programmable gate array (FPGA), and conventional circuit components arranged to perform the recited functions.

What is claimed is:

1. A sheet feeding device comprising:

a conveyance rotator to convey a sheet in a sheet feeding direction;

a separation rotator to sandwich the sheet together with the conveyance rotator;

a torque applier to apply a reverse torque to the separation rotator in a sheet reversing direction to reverse the sheet;

a torque control circuit configured to control the reverse torque applied to the separation rotator to be equal to or less than a given value; and a torque transmission switcher to switch, between a transmission state and a non-transmission state, a state of a torque transmission path between the torque applier and the separation rotator, the transmission state being a state in which the reverse torque is transmitted, the non-transmission state being a state in which the reverse torque is not transmitted, the sheet feeding device further comprising circuitry configured to cause the torque transmission switcher to switch the state of the torque transmission path from the non-transmission state to the transmission state at a time when the sheet is separable from at least one sheet conveyed together with the sheet between the conveyance rotator and the separation rotator, wherein the circuitry is configured to, after the torque transmission switcher switches the state of the torque transmission path from the non-transmission state to the transmission state, cause the torque transmission switcher to switch the state of the torque transmission path from the transmission state to the non-transmission state, after a predetermined period of time which is set based on a type of the sheet including a length of the sheet in the sheet feeding direction.

2. The sheet feeding device according to claim 1, further comprising a sheet detector to detect the sheet downstream from the separation rotator in the sheet feeding direction, wherein the circuitry is configured to, after the torque transmission switcher switches the state of the torque transmission path from the non-transmission state to the transmission state, cause the torque transmission switcher to switch the state of the torque transmission path from the transmission state to the non-transmission state, based on a result of detection made by the sheet detector.

3. The sheet feeding device according to claim 1, further comprising a rotational information acquirer to acquire rotational information of the separation rotator, wherein the circuitry is configured to, after the torque transmission switcher switches the state of the torque transmission path from the non-transmission state to the transmission state, cause the torque transmission switcher to switch the state of the torque transmission path from the transmission state to the non-transmission state, based on the rotational information acquired by the rotational information acquirer.

4. The sheet feeding device according to claim 1, further comprising an input receiver configured to receive an input of the type of the sheet.

5. The sheet feeding device according to claim 1, further comprising a multiple feeding detector to detect multiple feeding of sheets including the sheet downstream from the separation rotator in the sheet feeding direction, wherein the circuitry is configured not to cause the torque transmission switcher to switch the state of the torque transmission path from the non-transmission state to the transmission state when the multiple feeding detector detects no multiple feeding.

6. The sheet feeding device according to claim 1, wherein the torque control circuit is configured to change a magnitude of the reverse torque applied by the torque applier, in response to a setting of a type of the sheet.

7. The sheet feeding device according to claim 6, wherein:

the torque control circuit is configured to change the magnitude of the reverse torque applied by the torque applier, in response to a setting of a type of the sheet which includes at least one of a size of the sheet.

8. The sheet feeding device according to claim 6, wherein:

the torque control circuit is configured to change a magnitude of the reverse torque applied by the torque applier, in response to a setting of a type of the sheet which includes at least one of a thickness of the sheet and a surface roughness of the sheet.

9. The sheet feeding device according to claim 6, wherein:

the torque control circuit is configured to change a magnitude of the reverse torque applied by the torque applier, in response to a setting of a type of the sheet which includes a material of the sheet.

10. An image forming apparatus comprising:

an image forming device configured to form an image on a sheet; and the sheet feeding device according to claim 1, configured to feed the sheet to the image forming device.

11. The sheet feeding device according to claim 1, wherein:

the predetermined period of time is set using a table.

12. The sheet feeding device according to claim 1, wherein:

the predetermined period of time is set using a table which includes a time to turn on the clutch and a time to turn off the clutch based on a type of the sheet.

13. The sheet feeding device according to claim 1, wherein:

the predetermined period of time is set using a table which includes a time to turn on the clutch and a time to turn off the clutch based on a size of the sheet.

14. A method, comprising:

switching a state of a torque transmission path between a torque applier and a separation rotator from a non-transmission state to a transmission state at a time when a sheet is separable from at least one sheet conveyed together with the sheet between a conveyance rotator and the separation rotator, the transmission state being a state in which a torque is transmitted, the non-transmission state being a state in which the torque is not transmitted, wherein after switching the state of the torque transmission path from the non-transmission state to the transmission state, the method further switches a state of the torque transmission path from the transmission state to the non-transmission state, after a predetermined period of time which is set based on a type of the sheet including a length of the sheet in a sheet feeding direction.

15. The method according to claim 14, wherein:

the predetermined period of time is set using a table which includes a time to turn on the clutch and a time to turn off the clutch based on a type of the sheet.

16. The method according to claim 14, wherein:

the predetermined period of time is set using a table which includes a time to turn on the clutch and a time to turn off the clutch based on a size of the sheet.

* * * * *